US009551960B2

(12) United States Patent
Fujimoto et al.

(10) Patent No.: US 9,551,960 B2
(45) Date of Patent: Jan. 24, 2017

(54) IMAGE FORMING APPARATUS

(71) Applicant: CANON KABUSHIKI KAISHA, Tokyo (JP)

(72) Inventors: Tetsuichiro Fujimoto, Mishima (JP); Toshiaki Miyashiro, Suntou-gun (JP); Yasutaka Yagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/833,255

(22) Filed: Aug. 24, 2015

(65) Prior Publication Data

US 2016/0062276 A1 Mar. 3, 2016

(30) Foreign Application Priority Data

Aug. 28, 2014 (JP) ..... 2014-174413

(51) Int. Cl.
*G03G 15/16* (2006.01)
*G03G 21/00* (2006.01)

(52) U.S. Cl.
CPC ..... *G03G 15/161* (2013.01); *G03G 21/0064* (2013.01)

(58) Field of Classification Search
CPC ..... G03G 21/0064; G03G 2221/0073; G03G 15/161
See application file for complete search history.

(56) References Cited

U.S. PATENT DOCUMENTS 4,945,389 A * 7/1990 Usui ..... G03G 21/06 399/129
5,175,584 A * 12/1992 Usui ..... G03G 21/06 399/44
5,862,432 A * 1/1999 Nakayama ..... G03G 21/0005 399/129
6,744,994 B2 * 6/2004 Yoshikawa ..... G03G 21/0064 399/129
7,433,626 B2 10/2008 Takeuchi
9,025,209 B2 5/2015 Ichinose et al.
9,075,352 B2 7/2015 Seki et al.
9,086,671 B2 7/2015 Ichinose et al.
(Continued)

FOREIGN PATENT DOCUMENTS

JP 2000-131920 A 5/2000
JP 2005-316268 A 11/2005
(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

A CPU 26 sets the value of the applied voltage to a first set value when the absolute value of the amount of charge on the toner remaining on the intermediate transfer belt 8 is lower than a threshold value, and sets the value of the applied voltage to a second set value when the absolute value of the amount of charge on the toner remaining on the intermediate transfer belt 8 is equal to or greater than the threshold value, and when the first set value is $V_{C1}$ and the second set value is $V_{C2}$, the relationship $|V_{C1}|<|V_{C2}|$ is established.

9 Claims, 12 Drawing Sheets

(56) References Cited

U.S. PATENT DOCUMENTS

| | | | | |
|---|---|---|---|---|
| 2002/0034405 | A1* | 3/2002 | Kayahara | G03G 15/161 399/297 |
| 2009/0232530 | A1 | 9/2009 | Saito et al. | |
| 2011/0150532 | A1* | 6/2011 | Shimura | G03G 15/0233 399/175 |
| 2013/0108313 | A1* | 5/2013 | Katagiri | G03G 15/161 399/101 |
| 2013/0315616 | A1* | 11/2013 | Ohno | G03G 21/0047 399/101 |
| 2014/0147146 | A1* | 5/2014 | Kobayashi | G03G 15/161 399/66 |
| 2015/0093143 | A1 | 4/2015 | Funatani et al. | |

FOREIGN PATENT DOCUMENTS

| | | | |
|---|---|---|---|
| JP | 2007-272091 | A | 10/2007 |
| JP | 2009-205012 | A | 9/2009 |
| JP | 2009-288481 | A | 12/2009 |
| JP | 2010-060945 | A | 3/2010 |

* cited by examiner

IMAGE FORMATION SEQUENCE ACCORDING TO FIRST EMBODIMENT

IMAGE FORMATION SEQUENCE ACCORDING TO FURTHER EMBODIMENT

IMAGE FORMING APPARATUS

BACKGROUND OF THE INVENTION

Field of the Invention

The present invention relates to an image forming apparatus, for example, a copying machine or printer, which is provided with a function for forming an image on a recording material, such as a sheet.

Description of the Related Art

Image forming apparatuses based on an electrophotographic system include an image forming apparatus based on an intermediate transfer system which outputs an image by primary transfer of a toner image from a photosensitive body to an intermediate transfer belt, and then secondary transfer of the toner image onto a recording material. An intermediate transfer belt of an endless belt shape is widely used as an intermediate transfer belt. Broadly speaking, methods for cleaning remaining toner on an intermediate transfer belt in an intermediate transfer method are: a blade cleaning method, an electrostatic cleaning method and a hybrid method combining these.

The blade cleaning method is a method in which, as disclosed in Japanese Patent Application Publication No. 2009-288481, a cleaning blade is placed in contact with the intermediate transfer belt, and remaining toner on the intermediate transfer belt is physically scraped away by this cleaning blade. This cleaning method can be expected to provide good cleaning properties at low cost, but is liable to the effects of wear of the blade and unevenness of the surface of the intermediate transfer belt due to enduring use, and hence there is a concern that good cleaning performance cannot be maintained for a long period of time.

In the electrostatic cleaning method, as disclosed in Japanese Patent Application Publication No. 2009-205012, remaining toner is charged to the opposite polarity of the charged state during development, by a charging unit that applies a voltage to the remaining toner. Thereupon, the remaining toner which has been charged to the opposite polarity is transferred from the intermediate transfer belt to the photosensitive body in the next primary transfer step, and is collected by a cleaning unit that cleans the photosensitive body. Therefore, this method is known as a simultaneous transfer and cleaning method. The electrostatic cleaning method has an advantage in not being liable to the effects of unevenness in the surface of the intermediate transfer belt, but the following concerns arise when processing a large amount of remaining toner on the intermediate transfer belt, such as after dealing with a paper jam or after calibration. More specifically, when processing a large amount of remaining toner on the intermediate transfer belt, a large amount of toner adheres to the charging unit and this needs to be cleaned in order to maintain the cleaning performance. The cleaning by the charging unit in the electrostatic cleaning method involves ejecting (moving) the adhering toner by applying a bias of the same polarity as the toner, from the charging unit, and then collecting the ejected toner on the photosensitive body.

However, in collecting the ejected toner, since the charging polarity of the toner immediately after ejection is opposite to that of the primary transfer bias, then in a primary transfer portion the ejected toner cannot be collected on the photosensitive body immediately after being ejected. Therefore, the intermediate transfer belt must be rotated further and the ejected toner must be charged again to the same polarity as the primary transfer bias by the charging unit. Consequently, in the cleaning of the intermediate transfer belt after a jam or calibration, time is required to rotate the intermediate transfer belt that is used in the ejection step, and if this is long, then multiple rotations of the intermediate transfer belt may be necessary.

The hybrid cleaning method disclosed in Japanese Patent Application Publication No. 2000-131920 is a cleaning method of the following kind. Firstly, remaining toner on the intermediate transfer belt is removed generally by a cleaning blade situated to the downstream side of the secondary transfer portion in terms of the direction of rotation of the intermediate transfer belt. The remaining toner not scraped away by the cleaning blade is charged by the charging unit which is disposed to the downstream side of the cleaning blade in terms of the direction of rotation of the intermediate transfer belt, whereby simultaneous transfer and cleaning is performed onto the photosensitive body. In this hybrid method, since a large amount of remaining toner is not supplied to the charging unit, then there is no adherence of toner to the charging unit, even under conditions that give rise to a large amount of remaining toner, such as after a jam or calibration, etc. Therefore, surplus time for rotating the intermediate transfer belt to remove this toner is not necessary. Therefore, the hybrid cleaning method can achieve the smallest processing time (downtime) of the abovementioned three cleaning methods, and can achieve good cleaning performance over a long time.

However, in a hybrid cleaning method such as that described above, there is a concern in that problems such as the following arise when the size of the apparatus is reduced and/or the printing speed is increased. In order to achieve good cleaning performance with the hybrid method, it is necessary to charge the toner not scraped away by the cleaning blade, uniformly, to an opposite polarity. Therefore, the charging unit needs to generate an electric discharge that is at least capable of reversing the amount of charge on the toner that has not been scraped away. On the other hand, the charging unit also charges the surface of the intermediate transfer belt, as well as the toner, and therefore the amount of electric discharge needs to be limited in such a manner that the surface potential of the intermediate transfer belt after passing the charging unit does not affect the next primary transfer operation.

SUMMARY OF THE INVENTION

The present invention was devised in view of the circumstances described above, an object thereof being to ensure cleaning performance while suppressing the occurrence of image defects in a hybrid cleaning method.

In order to achieve the aforementioned object, the present invention provides an image forming apparatus, comprising:

an image bearing member which bears a toner image;

an intermediate transfer member which is movable and to which a toner image is primarily transferred from the image bearing member in a primary transfer portion;

a secondary transfer member to which a voltage of opposite polarity to a normal polarity of the toner is applied, and which secondarily transfers the toner image from the intermediate transfer member to a transfer material, in a secondary transfer portion;

a control unit; and a cleaning unit which cleans toner on the intermediate transfer member, the cleaning unit including: a cleaning member which contacts the intermediate transfer member and collects toner; and a charging member which is disposed on a downstream side of the cleaning member in terms of a direction of movement of the intermediate transfer member, and which charges the toner by receiving application of a voltage of the opposite polarity, wherein the control unit:

applies a first voltage to the charging member while causing the intermediate transfer member to move at a first speed of movement, when cleaning toner remaining on the intermediate transfer member due to not having been secondarily transferred to the transfer material, by the cleaning unit; and applies a second voltage having a greater absolute value than the first voltage, to the charging member, while causing the intermediate transfer member to move at a second speed of movement that is slower than the first speed of movement, when cleaning toner that has been primarily transferred to the intermediate transfer member, in a state where a voltage of the normal polarity has been applied to the secondary transfer member, or a state where the secondary transfer member has been separated from the intermediate transfer member, by the cleaning unit.

In order to achieve the aforementioned object, the present invention provides an image forming apparatus, comprising:

an image bearing member which bears a toner image;

an intermediate transfer member which is movable and to which a toner image is primarily transferred from the image bearing member in a primary transfer portion;

a secondary transfer member to which a voltage of opposite polarity to a normal polarity of the toner is applied, and which secondarily transfers the toner image from the intermediate transfer member to a transfer material, in a secondary transfer portion;

a control unit which sets a value of the application voltage applied to the charging member, on the basis of the absolute value of an amount of charge of the toner on the intermediate transfer member; and a cleaning unit which cleans toner on the intermediate transfer member, the cleaning unit including: a cleaning member which contacts the intermediate transfer member and collects toner; and a charging member which is disposed on a downstream side of the cleaning member in terms of a direction of movement of the intermediate transfer member, and which charges the toner by receiving application of a voltage of the opposite polarity, wherein the control unit sets a value of the applied voltage to a first set value when the absolute value of an amount of charge on the toner remaining on the intermediate transfer medium is lower than a threshold value, and sets a value of the applied voltage to a second set value, when the absolute value of the amount of charge is equal to or greater than the threshold value; and when the first set value is $V_1$ and the second set value is $V_2$;

then the relationship $|V_1|<|V_2|$ is established.

In order to achieve the aforementioned object, the present invention provides an image forming apparatus, comprising:

an image bearing member which bears a toner image;

an intermediate transfer member which is movable and to which a toner image is primarily transferred from the image bearing member;

a secondary transfer member to which a voltage of opposite polarity to a normal polarity of the toner is applied, and which secondarily transfers the toner image from the intermediate transfer member to a transfer material;

a control unit; and a charging member which charges the toner on the intermediate transfer member by receiving application of a voltage of the opposite polarity, wherein the control unit applies a first voltage to the charging member in an image formation mode for secondarily transferring, onto a transfer material, by the secondary transfer member, a toner image that has been primarily transferred onto the intermediate transfer member from the image bearing member; and applies a second voltage having a greater absolute value than the first voltage, to the charging member, in an adjustment mode for adjusting image formation conditions on the basis of a toner image for adjustment that has been transferred from the image bearing member to the intermediate transfer member.

Further features of the present invention will become apparent from the following description of exemplary embodiments (with reference to the attached drawings).

DESCRIPTION OF THE EMBODIMENTS

Hereinafter, aspects of the present invention will be exemplified in detail based on embodiments. However, dimensions, materials, shapes, relative positions, and the like of constituent components described in the embodiments are changed appropriately according to a configuration and various conditions of an apparatus to which the present invention is applied. That is, the scope of the present invention is not limited to the following embodiments.

[First Embodiment]

Below, a first embodiment is described.

1. Overall Configuration of Image Forming Apparatus

Figure 1:
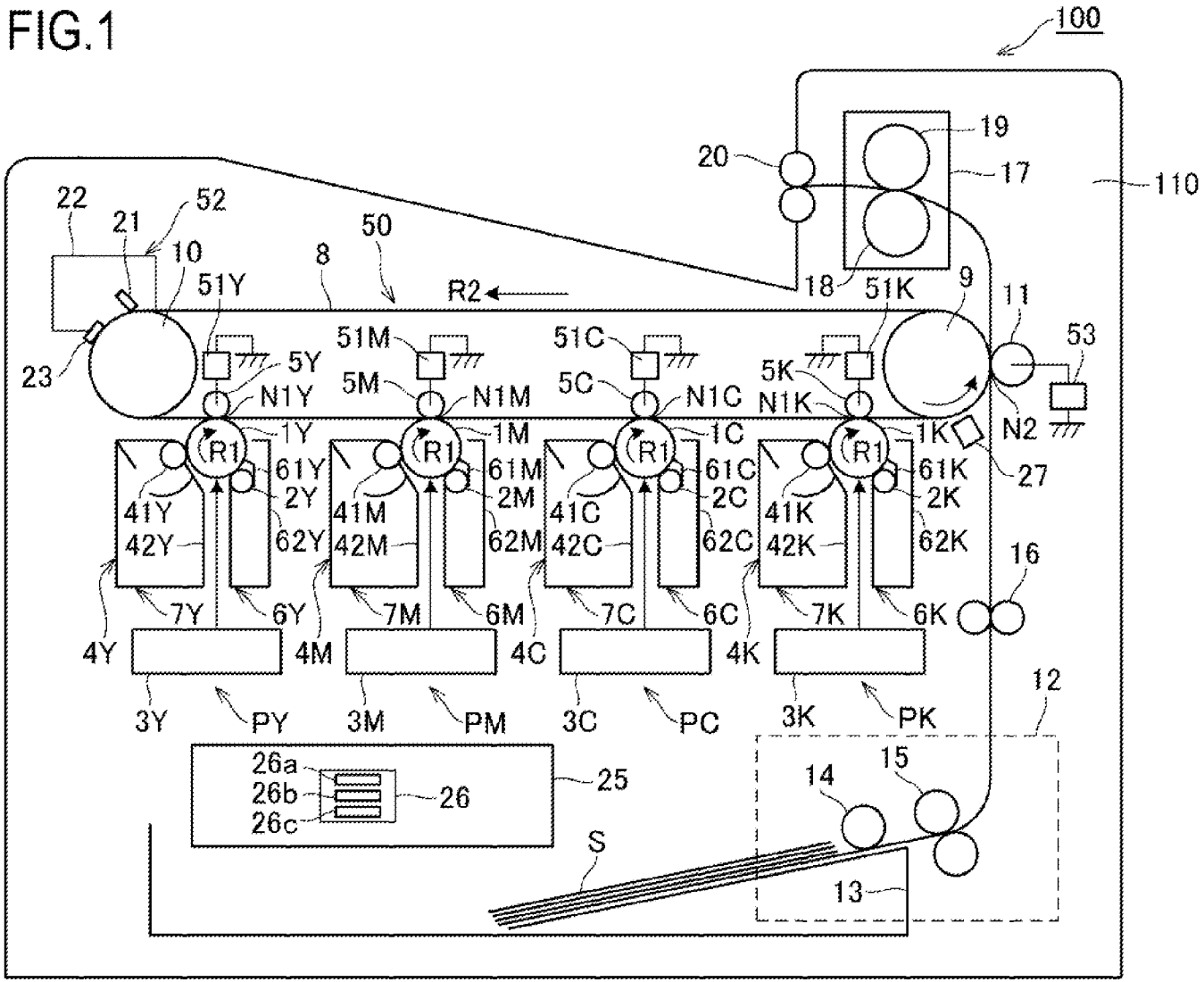
FIG. 1 is a schematic cross-sectional diagram of an image forming apparatus according to a first embodiment.

FIG. 1 is a schematic cross-sectional diagram of an image forming apparatus according to the present embodiment. The image forming apparatus 100 according to the present embodiment is a tandem-type image forming apparatus (laser beam printer) which employs an intermediate transfer method that forms a full-color image by using an electrophotographic system.

The image forming apparatus 100 has a plurality of image forming units P, namely, first, second, third and fourth image forming units PY, PM, PC, PK. The first, second, third and fourth image forming units PY, PM, PC, PK respectively form yellow (Y), magenta (M), cyan (C) and black (K) toner images.

In the present embodiment, the configuration and operation of the image forming units PY, PM, PC, PK is substantially the same, except for the difference in the color of toner used. Therefore, unless the units need to be differentiated in particular, the suffixes Y, M, C, K on the reference numerals which indicate the color element are omitted, and the description applies generally to all of the units.

The image forming unit P has a drum-type electrophotographic photosensitive member ("photosensitive body"), in other words, a photosensitive drum 1, as an image bearing member. The photosensitive drum 1 is driven to rotate by a drive unit (not illustrated) in a direction of arrow R1 in the drawings. Disposed about the periphery of the photosensitive drum 1, along the direction of rotation thereof, are: a primary charging roller 2 which is a primary charging unit configured by a roller-type charging member, an exposure device (laser unit) 3 which is an exposure unit (image writing unit), and a developing assembly 4 which is a developing unit. Subsequently, a primary transfer roller 5, which is a primary transfer member configured by a roller-type charging member, and a drum cleaner 6, which is a cleaning unit for the photosensitive body, are arranged.

The developing assembly 4 has a developing roller 41 which is a developer bearing member, and a toner container 42 which holds toner forming a developer. The drum cleaner 6 has a drum cleaning blade 61 and a waste toner container 62, as a cleaning unit.

The intermediate transfer belt 8, which is an endless, rotatable and intermediate transfer member, is spanned between a driver roller 9 and a tension roller 10, and is driven to rotate in the direction of arrow R2 in the drawings, due to receiving the transmission of drive force from the driver roller 9.

The primary transfer roller 5 is pressed towards the photosensitive drum 1 via the intermediate transfer belt 8, whereby the intermediate transfer belt 8 and the photosensitive drum 1 contact each other, forming a primary transfer portion (primary transfer nip, contact portion) N1. On the outer circumferential surface of the intermediate transfer belt 8, a secondary transfer roller 11 which forms a secondary transfer portion configured by a roller-type charging member is disposed at a position opposing the driver roller 9.

The secondary transfer roller (transfer member) 11 is pressed towards the driver roller 9 via the intermediate transfer belt 8, whereby the intermediate transfer belt 8 and the secondary transfer roller 11 contact each other, forming a secondary transfer portion (secondary transfer nip, contact portion) N2. Furthermore, a belt cleaner 52, which is a cleaning unit, is disposed at a position opposing the tension roller 10, on the outer circumferential surface side of the intermediate transfer belt 8.

The belt cleaner 52 has a belt cleaning blade 21, which is a scraping member, an electrically conductive brush 23 which is a charging member (contact charging member), and a waste toner container 22.

An intermediate transfer belt unit 50 is configured by the intermediate transfer belt 8, the driver roller 9, the tension roller 10 and the belt cleaner 52, and the like.

In the present embodiment, in each of the respective image forming units P, a process cartridge 7 is configured in which a photosensitive drum 1, a primary charging roller 2 which is a processing unit that acts on the photosensitive drum 1, a developing assembly 4 and a drum cleaner 6, are arranged in an integrated fashion. The process cartridges 7Y, 7M, 7C, 7K are each attachable to and detachable from the apparatus main body 110 of the image forming apparatus 100.

In the present embodiment, the process cartridges 7Y, 7M, 7C, 7K each have substantially the same configuration, and differ from each other in that the toners held in the respective toner containers 42Y, 42M, 42C, 42K are toners of the respective colors of yellow (Y), magenta (M), cyan (C) and black (K).

Furthermore, the image forming apparatus 100 is provided with a control board 25 on which an electrical circuit for controlling the image forming apparatus 100 is mounted. A CPU 26 which is a control unit is mounted on the control board 25.

The CPU 26 has a built-in algorithm which controls the operations of the apparatus on the basis of signals from various sensors in the apparatus, such as a drive control unit 26*a*, a charging bias selection unit 26*b*, an operational status monitoring unit 26*c*, and the like, and implements overall control of the operation of the image forming apparatus 100 relating to the whole image formation process. Here, the drive control unit 26*a* controls driving of the drive source relating to the conveyance of the recording material S, the drive source of the intermediate transfer belt 8 and the respective image forming units P, and so on. The charging bias selection unit 26*b* is one high-voltage control unit which selects an output value of the charging bias power source described below. The operation status (operation state) monitoring unit 26*c* is a remaining toner determination unit which determines the state (charged state, amount of charge) of remaining toner on the intermediate transfer belt 8 (on the intermediate transfer member).

2. Transfer Configuration

Next, the configuration relating to primary transfer and secondary transfer in the present embodiment is now described in more detail.

In the present embodiment, a belt-shaped intermediate transfer belt 8 which can easily be reduced in size, is used as the intermediate transfer member. The intermediate transfer belt 8 is an endless belt to which electrically conductive properties are imparted by adding electrically conductive agent to a resin material. The intermediate transfer belt 8 is spanned between two axes, namely, the driver roller 9 and the tension roller 10, and is tensioned with a total force of 100 N by the tension roller 10.

For the intermediate transfer belt 8 of the present embodiment, a 70 μm-thick endless belt is used, which is made from a polyimide resin adjusted to a volume resistivity of $1\times10^{10}$ Ω·cm by combining carbon as an electrically conductive agent. The characteristic electrical properties of the intermediate transfer belt 8 are indicated by the electron conductivity, and there is little variation in the electrical resistance with respect to the temperature and humidity of the atmosphere.

The range of the volume resistivity of the intermediate transfer belt 8 is desirably a range of no less than $1\times10^{9}$ Ω·cm and no more than $1\times10^{11}$ Ω·cm, from the viewpoint of transferability. If the volume resistivity is lower than $1\times10^{9}$ Ω·cm, then there is a concern that transfer defects may occur due to the escape of transfer current under high-temperature and high-humidity conditions. On the other hand, when the volume resistivity is higher than $1\times10^{11}$ Ω·cm, then there is a concern that transfer defects may occur due to abnormal electric discharge under low-temperature and low-humidity conditions.

Here, the volume resistivity of the intermediate transfer belt 8 is determined by the following measurement method. In other words, measurement was carried out using a Mitsubishi Chemicals Hiresta-UP (MCP-HT450), and a UR measurement probe, with the room temperature during measurement set to 23° C., the room humidity set to 50%, an applied voltage of 250 V and a measurement time of 10 sec.

In the present embodiment, a polyimide resin was used as the material of the intermediate transfer belt 8, but the material of the intermediate transfer belt 8 is not limited to this. For example, it is possible to use other materials such as the following, provided that the material is a thermoplastic resin. Examples of possible materials are: polyester, polycarbonate, polyarylate, acrylonitrile butadiene-styrene copolymer (ABS), polyphenylene sulphide (PPS), polyvinylidene fluoride (PVdF), polyethylene naphthalate (PEN), or the like, and combined resins of these.

The primary transfer roller 5 used an elastic roller having an outer diameter of 12 mm, formed by coating a core which is a nickel plated steel bar having an outer diameter of 6 mm, with an elastic layer which is 3 mm-thick foam sponge having NBR and epichlorohydrin rubber as main components and having a volume resistivity adjusted to $1\times10^7$ Ω·cm.

The primary transfer roller 5 is made to contact the photosensitive drum 1 via the intermediate transfer belt 8 at a pressing force of 9.8 N, and rotates passively due to the rotation of the intermediate transfer belt 8. Furthermore, when the toner on the photosensitive drum 1 is primarily transferred to the intermediate transfer belt 8, a 1500 V DC voltage (primary transfer bias) is applied to the primary transfer roller 5.

The secondary transfer roller 11 used an elastic roller having an outer diameter of 18 mm, formed by coating a core which is a nickel plated steel bar having an outer diameter of 8 mm, with an elastic layer which is 5 mm-thick foam sponge having NBR and epichlorohydrin rubber as main components and having a volume resistivity adjusted to $1\times10^8$ Ω·cm.

The secondary transfer roller 11 is made to contact the intermediate transfer belt 8 at a pressing force of 50 N, and rotates passively due to the rotation of the intermediate transfer belt 8. Furthermore, when toner on the intermediate transfer belt 8 is secondarily transferred onto the recording material S, such as paper, in the secondary transfer portion N2, then a DC voltage of 2500 V (secondary transfer bias) is applied to the secondary transfer roller 11.

3. Configuration of Belt Cleaner

Figure 2:
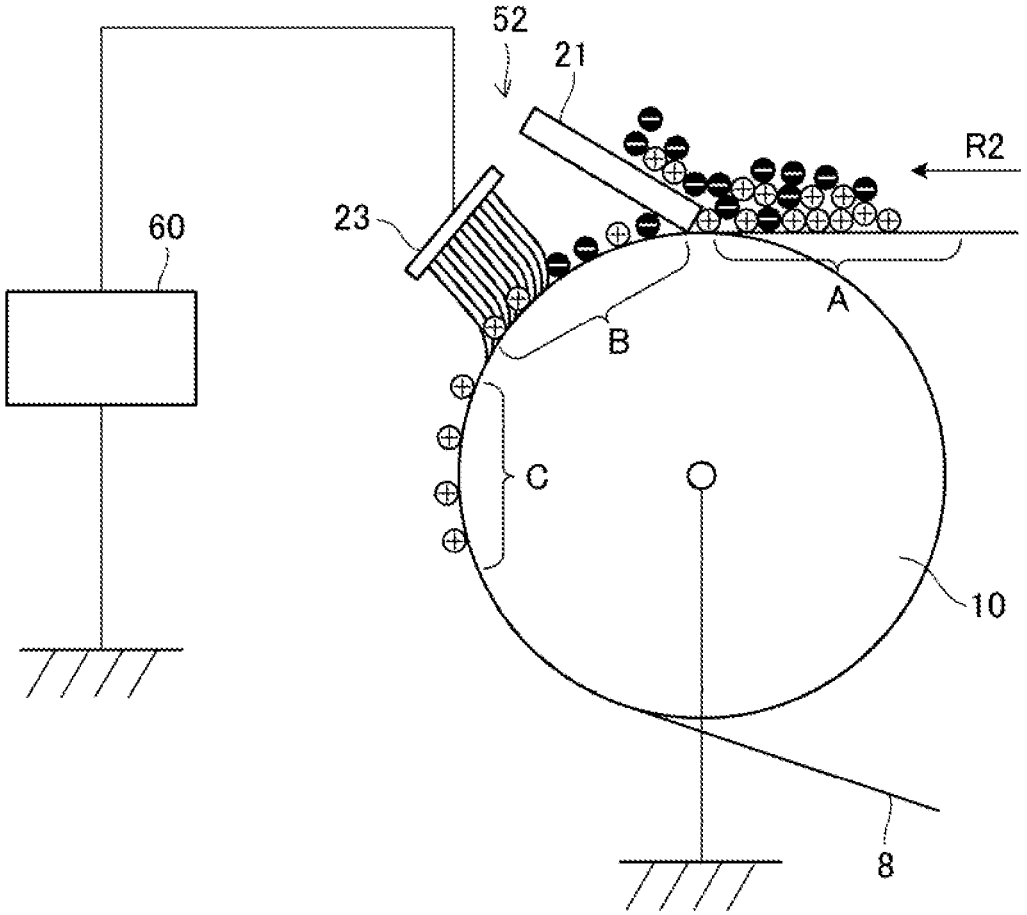
FIG. 2 is a schematic drawing showing the vicinity of a belt cleaner according to the first embodiment.

FIG. 2 is a schematic drawing showing a more detailed view of the vicinity of the belt cleaner 52 in the present embodiment. In the present embodiment, a hybrid cleaner configuration is used for the belt cleaner 52. In the belt cleaner 52, a belt cleaning blade 21 is disposed on the upstream side in the direction of movement of the intermediate transfer belt 8 (the direction of conveyance or direction of rotation), and the majority of the toner on the intermediate transfer belt 8 is scraped away by the belt cleaning blade 21. Thereupon, the toner which has not been scraped away (scraped off) by the belt cleaning blade 21 (called "unremoved toner" below), is charged by an electrically conductive brush 23 disposed to the downstream side in the direction of movement of the intermediate transfer belt 8.

The belt cleaning blade 21 and electrically conductive brush 23 are pressed towards the tension roller 10 via the intermediate transfer belt 8, and disposed in a state of contact with the intermediate transfer belt 8. Furthermore, the belt cleaning blade 21 and the electrically conductive brush 23 are supported on the waste toner container 22.

The belt cleaning blade 21 is a plate-shaped (blade-shaped) member made from an elastic material.

In the present embodiment, a plate-shaped member made from urethane, which is an elastic rubber material, is used for the belt cleaning blade 21. More specifically, in the present embodiment, a plate-shaped member having a lengthwise-direction length of 232 mm, a breadthways-direction length of 12 mm and a thickness of 2 mm is used for the belt cleaning blade 21.

Furthermore, the belt cleaning blade 21 is pressed in a counter direction with respect to the direction of movement R2 of the intermediate transfer belt 8, with a pressing force of approximately 0.49 N/cm linear pressure with respect to the intermediate transfer belt 8. In other words, the belt cleaning blade 21 contacts the intermediate transfer belt 8 through the whole range of the lengthwise direction, which is substantially perpendicular to the direction of movement R2 of the intermediate transfer belt 8, in such a manner that the free end in the breadthways direction that is substantially perpendicular to the lengthwise direction faces upstream in the direction of movement of the intermediate transfer belt 8.

The surface of the belt cleaning blade 21 in the edge portion of the free end on the intermediate transfer belt 8 side and/or a prescribed range from the edge portion towards the fixed end side, contacts the surface of the intermediate transfer belt 8.

In order to obtain good cleaning performance, as well as avoiding damage to the blade and/or belt due to unnecessarily strong pressing force, the linear pressure of the belt cleaning blade 21 is set desirably to 0.4 to 0.8 N/cm and more desirably, 0.55 to 0.67 N/cm. Here, the linear pressure of the belt cleaning blade 21 is the total contact pressure of the belt cleaning blade 21 with respect to the intermediate transfer belt 8 per unit length of the belt cleaning blade 21. This linear pressure can be determined by installing a load converter on the intermediate transfer belt 8, pressing the belt cleaning blade 21 against the surface of the intermediate transfer belt 8, and measuring the corresponding load.

The electrically conductive brush 23 is a brush-shaped member constituted by fibers having electrically conductive properties. A prescribed voltage (applied voltage) is applied to the electrically conductive brush 23 from the charging bias power source (high-voltage power source, voltage application unit) 60. Consequently, the unremoved toner can be charged.

Figure 3A:
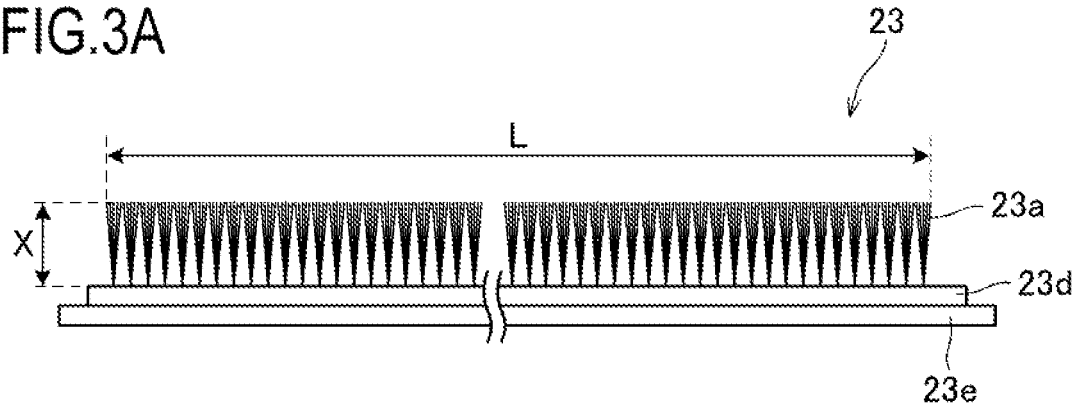
FIGS. 3A and 3B are schematic drawings showing a more detailed view of an electrically conductive brush according to the first embodiment.
Figure 3B:
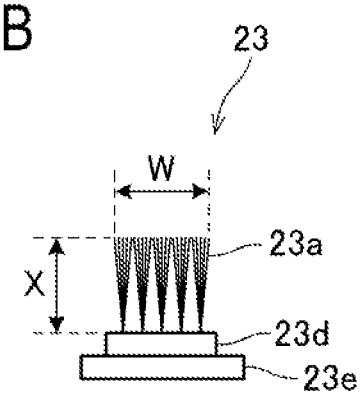

FIGS. 3A and 3B are schematic drawings showing a more detailed view of an electrically conductive brush 23.

In the present embodiment, the main component of the conductive fibers 23*a* which constitute the electrically conductive brush 23 is nylon, carbon is used as an electrically conductive agent, the resistance (electrical resistance) per unit length of one conductive fiber 23*a* is $1\times10^5$ Ω·cm, and the single-fiber fineness is 170 T/68 F. The single-fiber fineness in this case is expressed as the weight 170 T when one strand is constituted by a 68 F (filament) fiber, (dtex: weight of 10000 m length is 170 g).

Here, the resistance of the conductive fibers 23*a* is determined by the following measurement method.

Figure 4A:
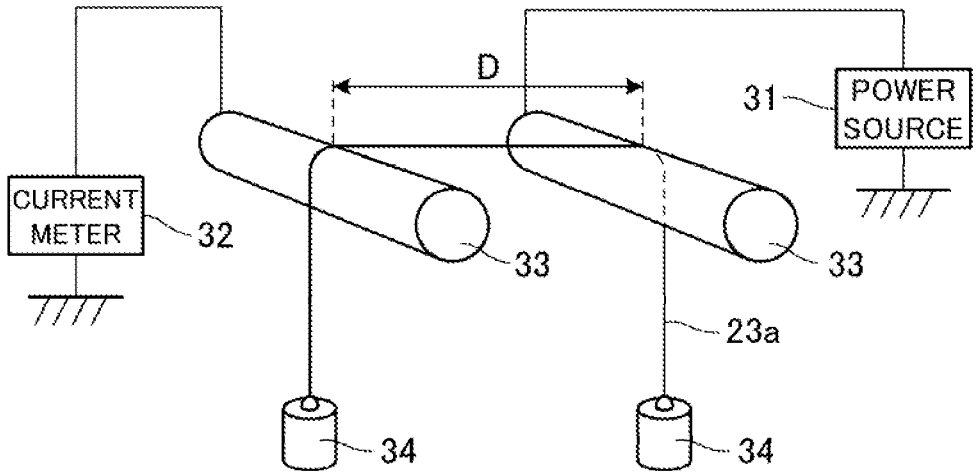
FIGS. 4A and 4B are diagrams for describing a method for determining a resistance value of conductive fibers according to the first embodiment.
Figure 4B:
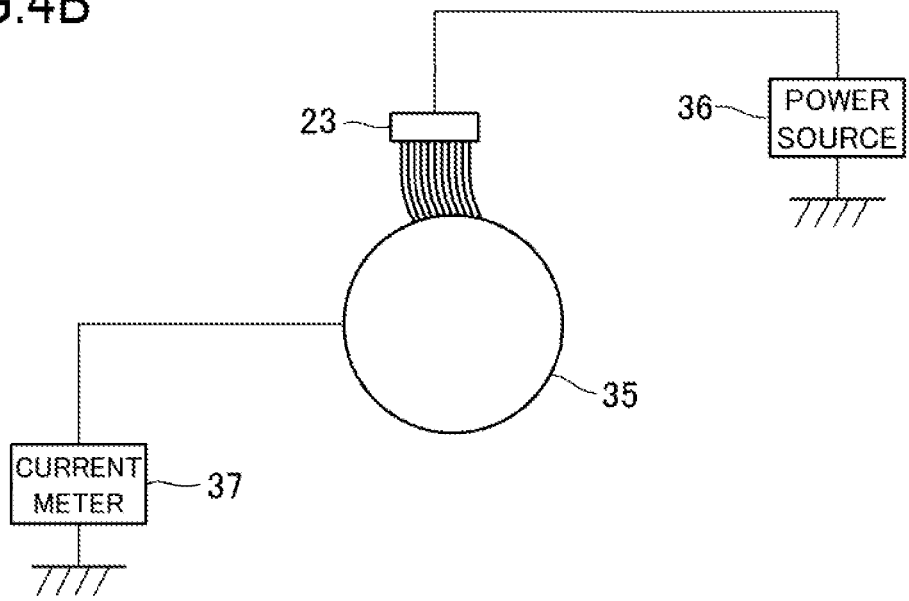

FIG. 4A is a diagram illustrating a method for determining the resistance of the conductive fibers 23*a*. Furthermore, FIG. 4B is a diagram illustrating a method for determining the resistance of the electrically conductive brush 23, which is described hereinafter.

As shown in FIG. 4A, the conductive fiber 23*a* to be measured is spanned between two 5 mm-diameter metal rollers 33 disposed at an interval of 10 mm (D) apart, and a load is applied to both ends of the fiber by a 100-gram weight 34 on each side.

In this state, a voltage of 200 V is applied to the conductive fiber 23*a* from a power source 31 via one of the metal rollers 33, the current value at that time is read by a current meter 32 connected to the other metal roller 33, and the resistance (Ω/cm) of the conductive fiber 23*a* per 10 mm (1 cm) is calculated. The range of the resistance value of the conductive fiber 23*a* is desirably no less than $1\times10^3$ Ω/cm and no more than $1\times10^7$ Ω/cm, from the viewpoint of charging the unremoved toner.

Next, the configuration of the electrically conductive brush 23 will be described.

The electrically conductive brush 23 is a collection of the conductive fibers 23*a* described above, and as shown in FIGS. 3A and 3B, in the present embodiment, the electrically conductive brush 23 is configured by weaving the conductive fibers 23*a* into a base cloth 23*d* made from nylon having insulating properties, so as to form a brush shape. The base cloth 23*d* is bonded by an electrically conductive adhesive which constitutes fixing means, onto a 1 mm-thick plate metal supporting member 23*e* made of stainless steel [SUS]. Therefore, the conductive fibers 23*a* woven into the base cloth 23*d* make contact with, and are electrically connected to, the supporting member 23*e* below the base cloth 23*d*. In the present embodiment, a voltage is applied to the electrically conductive brush 23 via this supporting member 23*e*.

In the present embodiment, the resistance (electrical resistance) of the electrically conductive brush 23, Rb[Ω], is $1\times10^3$Ω. Furthermore, the density of the conductive fibers 23*a* of the electrically conductive brush 23 is 100 kF/inch$^2$. Moreover, the length X of the conductive fibers 23*a* (represented by the perpendicular distance from the base surface of the base cloth 23*d* to the tip positions of the conductive fibers 23*a*) is 5 mm. Furthermore, the lengthwise width L of the electrically conductive brush 23 (the length between the ends of the tip portions of the conductive fibers 23*a* in the direction substantially perpendicular to the direction of movement of the intermediate transfer belt 8) is 225 mm. Furthermore, the breadthways width W of the electrically conductive brush 23 (the length between the ends of the tip portions of the conductive fibers 23*a* in the direction following the direction of movement of the intermediate transfer belt 8) is 5 mm.

The conductive fibers 23*a* of the electrically conductive brush 23 are arranged in five rows in the direction of movement of the intermediate transfer belt 8. Furthermore, the tip position of the electrically conductive brush 23 is fixed so as to achieve a penetration level of approximately 1.0 mm with respect to the surface of the intermediate transfer belt 8. Therefore, the electrically conductive brush 23 rubs against the surface of the moving intermediate transfer belt 8 (has a circumferential speed differential with respect to the surface of the intermediate transfer belt 8).

Here, the resistance Rb[Ω] of the electrically conductive brush 23 is determined by the following measurement method.

As shown in FIG. 4B, the electrically conductive brush 23 to be measured is made to contact a 30 mm-diameter metal roller 35 with a penetration level of 0.9 mm, and a voltage of 200 V is applied to the electrically conductive brush 23 from the power source 36. The current value in this case is read in by a current meter 37 connected to the metal roller 35, and the resistance value [Ω] of the electrically conductive brush 23 is calculated.

The resistance Rb of the electrically conductive brush 23 is in a range of no less than $1\times10^1$Ω and no more than $1\times10^5$Ω, in an electrically conductive brush 23 which uses conductive fibers 23*a* having a resistance value in the abovementioned range (no less than $1\times10^3$Ω and no more than $1\times10^7$Ω). By setting the resistance Rb of the electrically conductive brush 23 to the abovementioned range, it is possible to charge the unremoved toner satisfactorily, as well as obtaining a beneficial effect in suppressing soiling of the electrically conductive brush 23 due to adherence of toner.

Here, when the resistance Rb of the electrically conductive brush 23 is lower than $1\times10^1$Ω, then there is a concern that it may become impossible to control the charging bias to a desired value using an inexpensive high-voltage power source. Furthermore, if the resistance is greater than $1\times10^5$Ω, then there is a concern that toner is more liable to adhere to the electrically conductive brush 23. In addition to this, the resistance value of the electrically conductive brush 23 is increased by the adherence of toner, and hence there is a concern in that an even higher output voltage becomes necessary in order to ensure a prescribed amount of charge.

Furthermore, the resistance value (electrical resistance) Ri [Ω] of the intermediate transfer belt 8 in the portion where the intermediate transfer belt 8 and the electrically conductive brush 23 are in contact with each other is determined as indicated below.

The surface area of the portion where the intermediate transfer belt 8 and the electrically conductive brush 23 are in contact is substantially 5 mm×225 mm, since the breadthways width W of the electrically conductive brush 23 is 5 mm and the lengthwise width L thereof is 225 mm. Furthermore, the thickness of the intermediate transfer belt 8 is 70 μm. Consequently, the resistance value Ri of the intermediate transfer belt 8 in the portion where the intermediate transfer belt 8 and the electrically conductive brush 23 are in contact can be determined as indicated below, when the volume resistivity of the intermediate transfer belt is taken to be $1\times10^{10}$ Ω·cm. In other words, $1\times10^{10}$ Ω·cm×70 μm/(5 mm×225 mm)=$6.2\times10^6$Ω), and if an intermediate transfer belt 8 having a volume resistivity in the abovementioned range is used, then the resistance is in the range of no less than $6.2\times10^5$Ω to no more than $6.2\times10^7$Ω.

In this way, in the present embodiment, the electrical resistance of the electrically conductive brush 23 is set to be smaller than the electrical resistance of the contact portion of the intermediate transfer belt 8 which is in contact with the electrically conductive brush 23.

This is because the following effect becomes more liable to occur, when the electrical resistance of the electrically conductive brush 23 is greater than the electrical resistance of the contact portion of the intermediate transfer belt 8. The effect in question is soiling of the electrically conductive brush 23 due to the toner on the intermediate transfer belt flying over to the electrically conductive brush 23 before the charge of the toner is reversed by the electric discharge, in the portion to the upstream side of the contact portion (the non-contact portion).

The penetration level of the electrically conductive brush 23 into the intermediate transfer belt 8 (or the metal roller 35) is represented by the following distance. More specifically, the representative distance is the distance between the position where the tips of the conductive fibers 23*a* ought to be positioned, presuming that there is no deformation of the brush, and the surface of the intermediate transfer belt 8, in the normal direction (the direction substantially perpendicular to the surface of the intermediate transfer belt 8), at a central position of the electrically conductive brush 23.

4. Image Formation Process of Image Forming Apparatus

Below, an image formation process of the image forming apparatus 100 according to the present embodiment will be described.

When forming an image in the image forming apparatus 100, the outer circumferential surface of the photosensitive drum 1 which rotates is charged to a prescribed electric potential of a prescribed polarity (in the present embodiment, a negative polarity) by a primary charging roller 2 to which a primary charging bias of a prescribed polarity (in the present embodiment, a negative polarity) is applied. Thereafter, the surface of the charged photosensitive drum 1 is exposed on the basis of an image signal by an exposure device 3. Thereby, an electrostatic latent image (electrostatic image, latent image) is formed on the photosensitive drum 1.

This electrostatic latent image is developed (made visible) as a toner image by using toner, in the developing assembly 4. In this case, a developing bias of a prescribed polarity (in the present embodiment, a negative polarity) is applied to the developing roller 41. In the present embodiment, a toner image is formed on the photosensitive drum 1 by image exposure and inverse development. In other words, a toner image is formed by causing toner charged to the same polarity as the charging polarity of the photosensitive drum 1 to adhere to an exposed portion on a photosensitive drum 1 where the absolute value of the potential has been reduced by exposure after uniform charging of the drum. In the present embodiment, the toner used for development is charged to a negative polarity. In other words, the charging polarity of the toner during development (the normal charging polarity of the toner) is negative.

As described above, in the primary transfer portion N1, the toner image formed on the photosensitive drum 1 which rotates is transferred (in primary transfer) onto the intermediate transfer belt 8 which rotates at substantially the same velocity as the photosensitive drum 1 in contact with the photosensitive drum 1. In this case, a primary transfer bias of the opposite polarity to the charging polarity of the toner during development (in the present embodiment, a positive polarity) is applied to the primary transfer roller 5 from a primary transfer bias power source (high-voltage power source) 51 forming primary transfer bias application means.

For example, when forming a full-color image, the toner images formed on the photosensitive drums 1Y, 1M, 1C, 1K of the first, second, third and fourth image forming units PY, PM, PC, PK are transferred onto the intermediate transfer belt 8, successively in mutually overlapping fashion. The toner images of four colors are conveyed to the secondary transfer portion N2 by the rotation of the intermediate transfer belt 8, in a mutually superimposed state.

On the other hand, the recording material S conveyed out from a feed conveyance device 12 is conveyed to the secondary transfer portion N2 by a resist roller pair 16. The feed conveyance device 12 has a feed roller 14 for feeding the recording material S out from inside a cassette 13 which holds the recording material S, and a conveyance roller pair 15 which conveys the recording material S that has been fed out. The recording material S conveyed from the feed conveyance device 12 is conveyed to the secondary transfer portion N2 in synchronism with the toner images on the intermediate transfer belt 8, by the resist roller pair 16.

In the secondary transfer portion N2, the toner image on the intermediate transfer belt 8 is transferred (secondary transfer) to the recording material S that is sandwiched and conveyed between the intermediate transfer belt 8 and the secondary transfer roller 11. In this case, a secondary transfer bias of the opposite polarity to the charging polarity of the toner during development (in the present embodiment, a positive polarity) is applied to the secondary transfer roller 11 from a secondary transfer bias power source (high-voltage power source) 53 forming a secondary transfer bias application unit.

The recording material S onto which the toner image has been transferred is conveyed to a fixing apparatus 17 which constitutes a fixing unit. The toner image is fixed onto the surface of the recording material S by the recording material S being sandwiched and conveyed, and receiving the application of heat and pressure, by a fixing film 18 and a pressurization roller 19 of the fixing apparatus 17.

The recording material S on which the toner image has been fixed is output to the outside of the apparatus main body 110 by the output roller pair 20.

The toner remaining on the surface of the photosensitive drum 1 after the primary transfer step (primary untransferred toner) is cleaned off by the drum cleaner 6. In other words, the primary untransferred toner is scraped away from the rotating photosensitive drum 1 by the drum cleaning blade 61 which is disposed in contact with the photosensitive drum 1, and is collected into the waste toner container 62.

The image formation process for forming an image on the recording material S has been described above.

Here, in the image forming apparatus 100 of the present embodiment, there is also an image formation process (called "calibration" below) for forming an image for detection on the intermediate transfer belt for the purpose of stabilizing the toner density in the printed image, or adjusting the printing positions of the respective colors on the intermediate transfer belt 8.

In the image formation process for calibration, a patch image is formed on the intermediate transfer belt 8. The density of the patch image is detected by a density sensor 27 which is positioned to the downstream side of the fourth image forming unit PK in terms of the intermediate transfer belt 8, and on the basis of this result, the developing bias value supplied to the developing assembly 4 and the exposure start timing of the exposure device 3 are varied. A secondary transfer reverse bias $V_{T2R}$ of the same polarity as the toner is applied to the secondary transfer roller 11 during this calibration in order to prevent adherence of toner to the intermediate transfer belt 8.

5. Intermediate Transfer Belt Cleaning Step

Below, a step for cleaning the intermediate transfer belt 8 according to the present embodiment, following the above-mentioned image formation process, will be described.

In the present embodiment, a hybrid cleaning method is used. Therefore, the majority of the toner processed by cleaning on the intermediate transfer belt 8 is scraped off the intermediate transfer belt 8 by the belt cleaning blade 21 and collected on the waste toner container 22. Here, the belt cleaning blade 21 is arranged to the downstream side of the secondary transfer portion N2 in terms of the direction of movement of the intermediate transfer belt 8, and so as to contact the intermediate transfer belt 8 to the upstream side of the primary transfer portion N1. Moreover, the electrically conductive brush 23 is arranged to the downstream side of the belt cleaning blade 21 in terms of the direction of movement of the intermediate transfer belt 8, and to the upstream side of the primary transfer portion N1.

The unremoved toner that is not scraped away by the belt cleaning blade 21 is charged by the electrically conductive brush 23 to the opposite polarity of the charging polarity of the toner during development.

Below, characteristic features of the cleaning step according to the present embodiment will be described.

In the cleaning step according to the present embodiment, firstly, the state of the toner on the intermediate transfer belt 8 (the charging state, charge amount) is determined by the remaining toner determination unit. The charging bias value $V_C$ supplied to the electrically conductive brush 23 from the charging bias power source 60 is configured so as to be variable by the charging bias selection unit 26*b*, in accordance with the determination result.

Furthermore, in the cleaning step according to the present embodiment, it is possible to delay the image formation timing $T_C$, which is the image formation start timing of the image formed after selecting the charging bias, compared to the previously set timing, in accordance with the selected charging bias value $V_C$.

The method for changing the charging bias value $V_C$ and the image formation timing $T_C$ in the cleaning step according to the present embodiment will now be described.

In the present embodiment, an operational status monitoring unit 26*c* which monitors the operation of the image forming apparatus 100 is used as a remaining toner determination unit for determining the state of the toner on the intermediate transfer belt 8 according to the present embodiment. Here, the toner remaining on the surface of the intermediate transfer belt 8 after the secondary transfer step (secondary transfer operation) is called "secondary untransferred toner" below. Furthermore, toner remaining on the surface of the intermediate transfer belt 8 in an image formation operation that does not involve a secondary transfer step onto the recording material S, for example, after a jam or after calibration, is called "remaining toner".

The operational status monitoring unit 26*c* according to the present embodiment determines at least whether the unremoved toner on the intermediate transfer belt 8 supplied to the electrically conductive brush 23 is secondary untransferred toner or remaining toner, by monitoring the operational status of the image forming apparatus 100.

Figure 5:
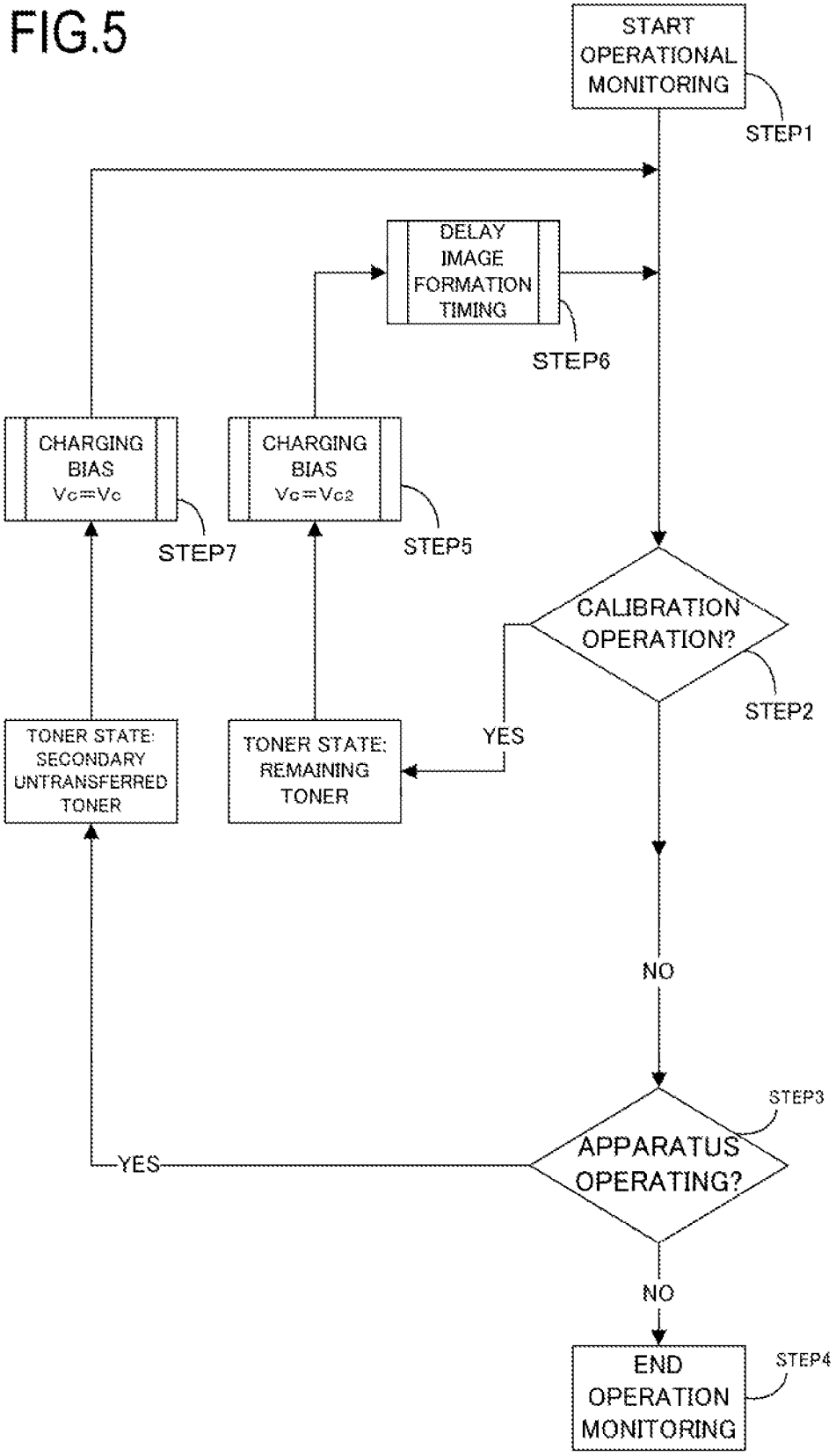
FIG. 5 is a diagram showing a flowchart of a monitoring flow by an operational status monitoring unit according to the first embodiment.

FIG. 5 is a diagram showing a flowchart of the monitoring flow of the operational status monitoring unit 26*c* according to the present embodiment.

Below, the monitoring flow of the operational status monitoring unit 26*c* is described with reference to the flowchart shown in FIG. 5. The flowchart is a determination flow in a case where a calibration operation has arisen during printing, in the operation of the image forming apparatus 100.

(STEP 1) The operational status monitoring unit 26*c* starts operational monitoring together with the driving of the drive unit of the apparatus main body 110.

(STEP 2) Next, it is determined whether the operation of the apparatus main body 110 is a calibration operation or another operation, from the print data provided to the exposure device 3. In STEP 2, if the operation of the apparatus main body 110 is determined not to be a calibration operation (NO), then the procedure transfers to STEP 3. In STEP 2, if the operation of the apparatus main body 110 is determined to be a calibration operation (YES), then the charging bias selection unit 26*b* is notified that the toner on the intermediate transfer belt 8 is remaining toner. In this case, the charging bias selection unit 26*b* sets the charging bias value $V_C$ to a second charging bias value $V_{C2}$ (second set value $V_2$) (STEP 5). Thereafter, the charging bias selection unit 26*b* notifies the CPU 26 that the charging bias value has changed. In so doing, from among the images formed after forming a calibration image, the CPU 26 selects an image A that has a possibility of being transferred to a position on the intermediate transfer belt where the calibration image has been transferred, and delays the image formation timing $T_C$ of the image by the delay time ΔT. (STEP 6)

After STEP 6, the procedure returns to STEP 2.

(STEP 3) It is determined whether or not the drive unit of the apparatus main body 110 is driving. In STEP 3, if it is determined that the drive unit of the apparatus main body 110 is not driving (NO), then the procedure transfers to STEP 4. In STEP 3, if the drive unit of the apparatus main body 110 is driving (YES), then the charging bias selection unit 26*b* is notified that the toner on the intermediate transfer belt is secondary untransferred toner. In this case, the charging bias selection unit 26*b* sets the charging bias value $V_C$ to a first charging bias value $V_{C1}$ (first set value $V_1$) (STEP 7). After STEP 7, the procedure returns to STEP 2.

(STEP 4) The operational monitoring is terminated.

Next, a cleaning step in a case where the unremoved toner on the intermediate transfer belt 8 is determined by the operational status monitoring unit 26*c* to be secondary untransferred toner will be described.

When the toner on the intermediate transfer belt 8 is determined to be secondary untransferred toner by the operational status monitoring unit 26*c*, then the charging bias selection unit 26*b* to which this information has been transmitted sets the charging bias value to a first charging bias value $V_{C1}$. In this case, the charging bias selection unit 26*b* sets the charging bias value to the first charging bias value $V_{C1}$ before the secondary untransferred toner is left by the belt cleaning blade 21 and reaches the electrically conductive brush 23.

In response to this, the charging bias power source 60 applies a charging bias controlled constantly to the first charging bias value $V_{C1}$ to the electrically conductive brush 23. The toner which has been charged to the opposite polarity of the normal charging polarity of the toner by the electrically conductive brush 23 to which the first charging bias value $V_{C1}$ has been applied moves from the intermediate transfer belt 8 to the photosensitive drum 1Y in the primary transfer portion N1Y of the first image forming unit PY where the next image formation process is carried out. In this way, the toner which has moved to the photosensitive drum 1Y is collected by the drum cleaner 6.

In the present embodiment, the first charging bias value $V_{C1}$ is set to 600 V.

Furthermore, in the image forming apparatus 100 according to the present embodiment, A4-size images are formed on the intermediate transfer belt 8 at intervals of 30 mm between images, at a processing speed of 210 mm/sec. More specifically, the image forming apparatus 100 according to the present embodiment forms A4-size images repeatedly on the photosensitive drum 1, at intervals of approximately 1557 msec between one image formation timing $T_C$ and the next image formation timing $T_C$.

When the first charging bias value $V_{C1}$ is selected by the charging bias selection unit 26*b*, then the CPU 26 controlling image formation does not change the interval between the image formation timings $T_C$. Therefore, the interval between images of 30 mm is maintained.

Next, a cleaning step in a case where the toner on the intermediate transfer belt 8 is determined by the operational status monitoring unit 26*c* to be remaining toner generated during calibration will be described.

When the toner on the intermediate transfer belt 8 is determined to be remaining toner by the operational status monitoring unit 26*c*, then the charging bias selection unit 26*b* to which this information has been transmitted sets the charging bias value to a second charging bias value $V_{C2}$. In this case, the charging bias selection unit 26*b* sets the charging bias value to the second charging bias value $V_{C2}$ immediately before the remaining toner is left by the belt cleaning blade 21 and reaches the electrically conductive brush 23.

In response to this, the charging bias power source 60 applies a charging bias controlled constantly to the second charging bias value $V_{C2}$, to the electrically conductive brush 23. The toner charged to the opposite polarity by the electrically conductive brush 23 to which the second charging bias value $V_{C2}$ has been applied is moved and collected onto the photosensitive drum 1Y in the first image forming unit PY.

In this case, in the first image forming unit PY, primary transfer of the next image is not carried out on the photosensitive drum 1Y.

In other words, when the operational status monitoring unit 26*c* has determined that the toner on the intermediate transfer belt 8 is remaining toner, then the CPU 26 which controls image formation delays the image formation timing $T_C$ at which the image formation of the next image is started, by a delay time ΔT with respect to the predetermined timing. Here, the CPU 26 delays the interval until the image formation timing $T_C$ for starting formation of the next image, by a delay time ΔTm, until the toner charged to an opposite polarity by the electrically conductive brush 23 is moved and collected on the photosensitive drum 1Y in the first image forming unit PY. The image formation timing in this case may be the timing at which no remaining toner is present on the opposing intermediate transfer belt 8, when the leading edge of the image on the photosensitive drum 1Y formed by starting the exposure reaches the primary transfer portion N1 (the primary transfer timing).

In the present embodiment, a toner image having a size of approximately 300 mm is formed in the circumferential direction of the intermediate transfer belt 8, as a calibration image. Therefore, the delay time ΔT of the image formation timing $T_C$ needs to be approximately 1688 msec, if an image is formed at the image formation timing $T_C$ according to the present embodiment. This means that the time taken for at least the leading end to the trailing end of the calibration image to pass through the first image-formation unit PY is required to be approximately 1550 msec or longer, taking account of the movement time from the electrically conductive brush 23 to the first image forming unit PY (approximately 146 msec). Furthermore, in the present embodiment, the second charging bias value $V_{C2}$ is set to 800 V.

Figure 6:
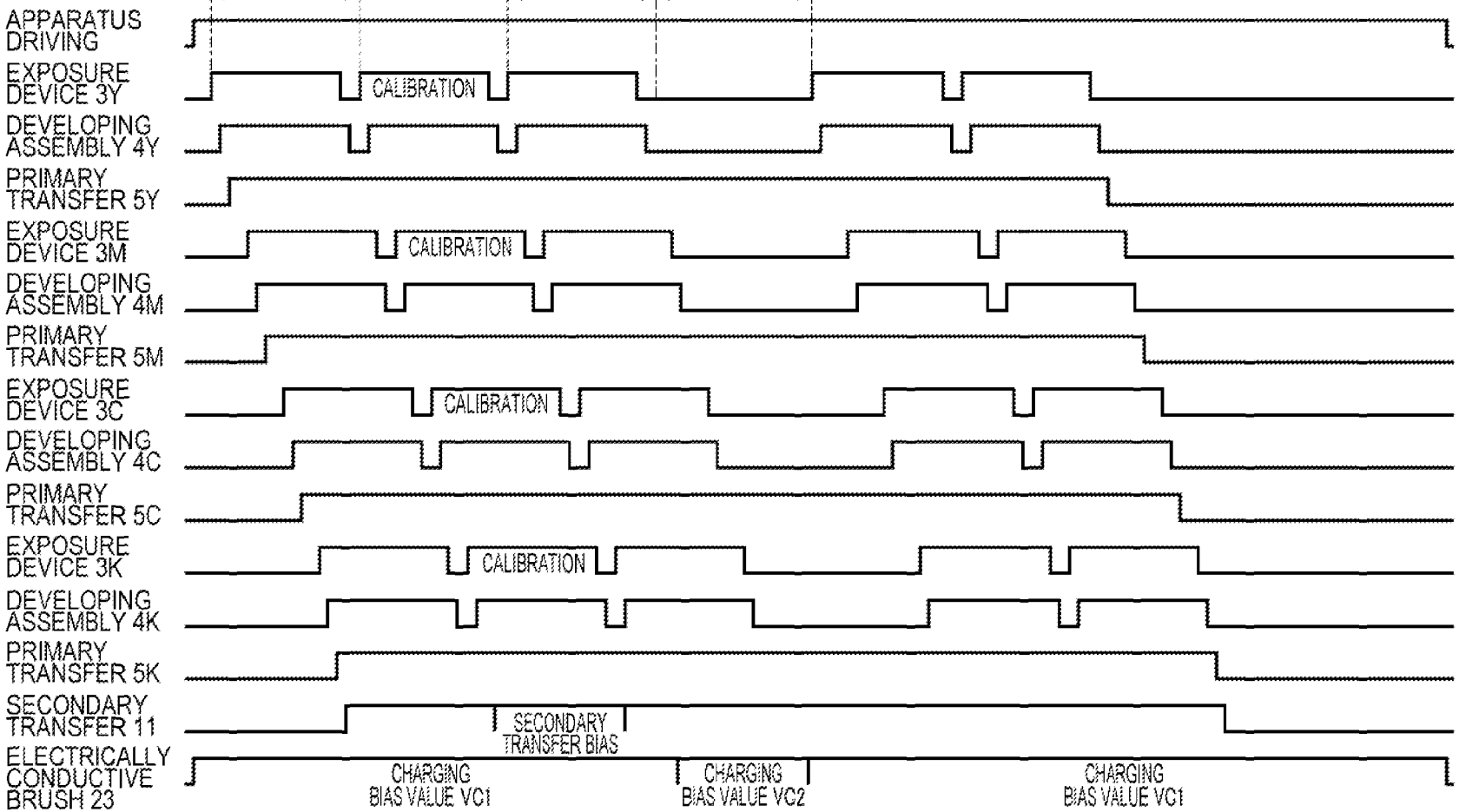
FIG. 6 is a diagram showing a timing chart of a calibration operation according to the first embodiment.

FIG. 6 is a diagram showing a timing chart when a calibration operation is carried out during a printing operation in the image forming apparatus 100 according to the embodiment. In FIG. 6, as stated previously, the calibration image created on the intermediate transfer belt 8 by the calibration operation is a toner image of approximately 300 mm size in the circumferential direction of the intermediate transfer belt 8.

In the present embodiment, as shown in FIG. 6, calibration is carried out between image formation on a first sheet and a second sheet. On the other hand, the image which is primarily transferred onto the portion of the intermediate transfer belt 8 where the charging bias value $V_{C2}$ is applied is the third image, and therefore the image formation timing $T_C$ is delayed in the interval between the second and third image formation timings $T_C$.

6. Description of Charging Bias Value $V_C$ According to Present Embodiment

In the cleaning step according to the present embodiment, firstly, the state of the toner on the intermediate transfer belt 8 is determined by the operational status monitoring unit 26*c*, as described above. The charging bias value applied from the charging bias power source 60 to the electrically conductive brush 23 is set to $V_{C1}$ or $V_{C2}$ by the charging bias selection unit 26*b*, depending on whether the untransferred toner is secondary untransferred toner or remaining toner. The description given below indicates the reasons why the charging bias value is set accordingly to the first charging bias value $V_{C1}$ or the second charging bias value $V_{C2}$, depending on whether the toner remaining on the intermediate transfer belt 8 is secondary untransferred toner or remaining toner, as stated above.

Firstly, the charging characteristics of the electrically conductive brush 23 will be described.

Figure 7:
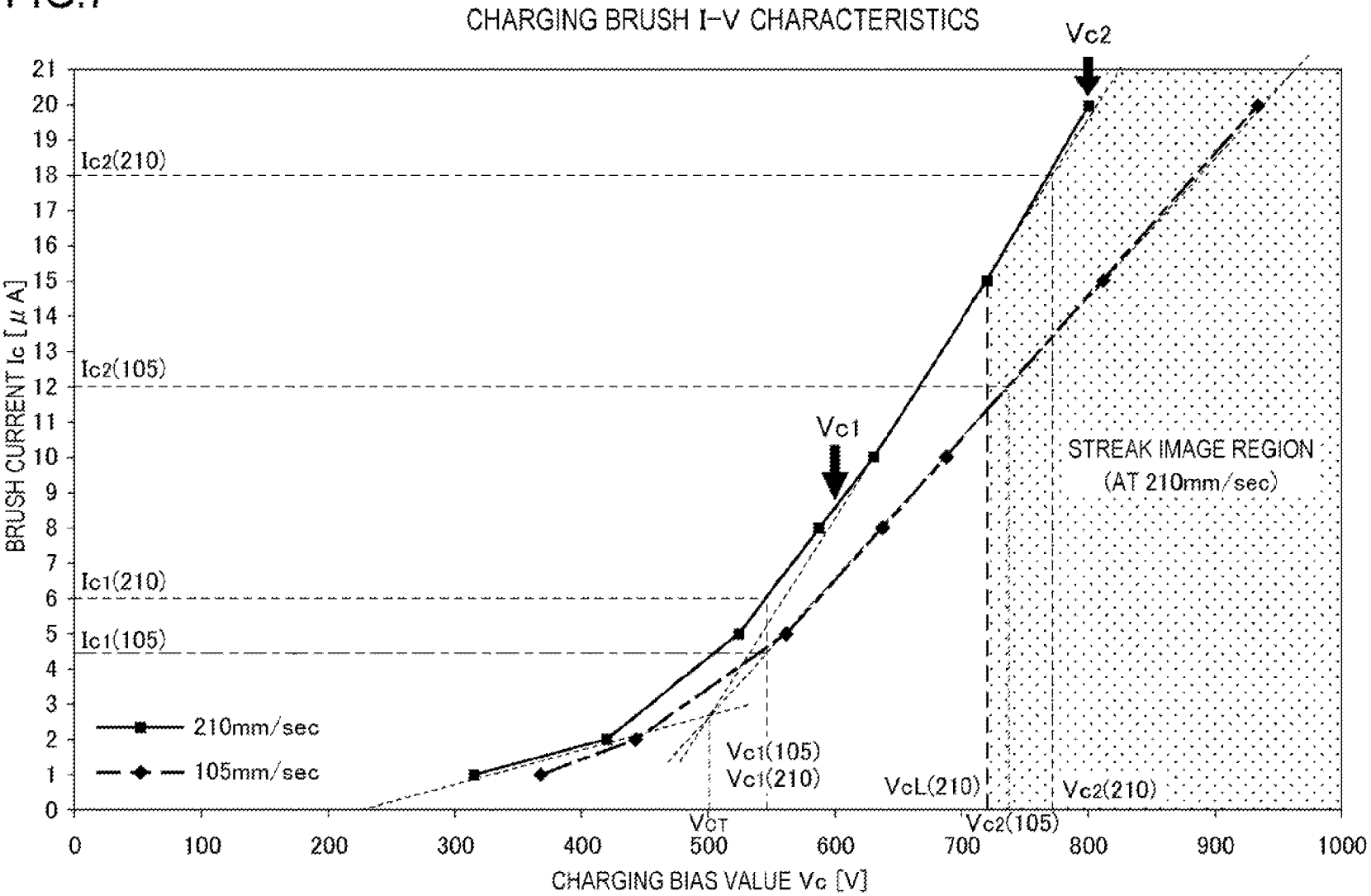
FIG. 7 is a drawing showing the I-V characteristics of an electrically conductive brush according to the first embodiment.

FIG. 7 is a chart showing I-V characteristics which indicate the charging characteristics of the electrically conductive brush 23 used in the image forming apparatus 100 of the present embodiment, and this diagram serves to illustrate the electric discharge threshold value.

For the purposes of comparison, FIG. 7 shows I-V characteristics of the electrically conductive brush 23 when the process speed used in the image forming apparatus 100 of the present embodiment (called "PS" below) is 210 mm/sec and when the process speed is half this value, or 105 mm/sec. In FIG. 7, the suffixes (210), (105) of the charging bias value $V_C$ and the brush current $I_C$ in FIG. 7 indicate the respective values when operating at a PS of 210 mm/sec and 105 mm/sec.

In FIG. 7, when the charging bias value $V_C$ to the electrically conductive brush 23 is changed, the brush current $I_C$ increases linearly in accordance with the increase in the applied charging bias, and the gradient thereof tends to vary greatly near about 500 V, regardless of the process. This is due to the fact that the state of movement of the charge from the electrically conductive brush 23 to the intermediate transfer belt changes with the start of electric discharge between the surface of the electrically conductive brush 23 and the surface of the intermediate transfer belt 8, and the current flowing between the electrically conductive brush 23 and the intermediate transfer belt 8 increases sharply. The point of change in the I-V characteristics is the electric discharge threshold value $V_{CT}$. Here, the first charging bias value $V_{C1}$ and the second charging bias value $V_{C2}$ used in the present embodiment are both values greater than the electric discharge threshold value $V_{CT}$. FIG. 7 shows the charging bias value $V_{C1(210)}$ and the charging bias value $V_{C2\ (210)}$ when the charge bias applied to the electrically conductive brush 23 is changed in the image forming apparatus 100. The charging bias value $V_{C1(210)}$ is the charging bias value which permits simultaneous transfer and cleaning of secondary untransferred toner at a PS of 210 mm/sec. Furthermore, the charging bias value $V_{C2(210)}$ is the charging bias value which permits simultaneous transfer and cleaning of remaining toner occurring in a jam processing step or calibration step, at a PS of 210 mm/sec.

Furthermore, FIG. 7 also shows a streak image critical voltage $V_{CL(210)}$ at which a streak image occurs, when the charging bias value $V_C$ is variable and formation of a next image is carried out without changing the image formation timing $T_C$. The streak image critical voltage $V_{CL(210)}$ is described in detail below.

As can be seen from FIG. 7, the first charging bias value $V_{C1}$ of the present embodiment is set to be higher than the charging bias value $V_{C1(210)}$ which permits cleaning of the secondary untransferred toner and lower than the streak image critical voltage $V_{CL(210)}$ at which a streak image occurs. Furthermore, the second charging bias value $V_{C2}$ is set to be higher than the charging bias value $V_{C2(210)}$ that permits cleaning of the remaining toner and also higher than the streak image critical voltage $V_{CL(210)}$ at which a streak image occurs.

Next, the reason why the charging bias value $V_C$ is set to different values of $V_{C1(210)}$ and $V_{C2(210)}$, when the toner on the intermediate transfer belt 8 is secondary untransferred toner and when the toner on the intermediate transfer belt 8 is other remaining toner, will be explained.

The characteristics of the toner supplied to the electrically conductive brush 23 on the intermediate transfer belt 8 differ greatly depending on whether the toner is secondary untransferred toner created by an image formation operation which involves a secondary transfer step, or remaining toner created by an image formation operation which does not involve a secondary transfer step.

For example, with the toner used in the image forming apparatus 100 according to the present embodiment, the amount of charge on the intermediate transfer belt 8 after primary transfer is approximately −25 to −35 μC/mg.

However, the amount of charge on the toner on the intermediate transfer belt 8 after secondary transfer decreases to approximately −5 μC/mg due to the secondary transfer bias of approximately 2500 V being applied to the toner in the secondary transfer portion N2. Consequently, the amount of charge on the unremoved toner which is not scraped away by the belt cleaning blade 21 and which is conveyed to the electrically conductive brush 23, also varies greatly depending on whether or not the toner is toner to which a secondary transfer bias has been applied in the processes thus far.

In particular, in a calibration step or a jam processing step, when a large amount of toner on the intermediate transfer belt 8 passes the secondary transfer roller 11, a secondary transfer reverse bias of negative polarity, which is opposite to the secondary transfer bias, is applied so as to avoid soiling of the secondary transfer roller 11 by this toner. Therefore, the amount of charge on the toner does not become lower than approximately −25 to −35 μC/mg, which is the amount of charging after primary transfer.

Therefore, the amount of charge on the unremoved toner varies greatly between secondary untransferred toner and remaining toner, and the brush current $I_C$ required to charge the toner uniformly to a reverse polarity differs respectively for each case.

The present inventors measured the brush current $I_C$ that permits simultaneous transfer and cleaning in the first image forming unit PY, of secondary untransferred toner and remaining toner, respectively, at a PS of 105 mm/sec and a PS of 210 mm/sec in the image forming apparatus 100 according to the present embodiment.

As a result of this, the brush current $I_{C1(105)}$ required for the secondary untransferred toner and the brush current $I_{C2(105)}$ required for remaining toner at a PS of 105 mm/sec was respectively approximately 4.5 μA and approximately 12 μA. Furthermore, in a similar fashion, the brush current $I_{C1(210)}$ and the brush current $I_{C2(210)}$ were respectively approximately 6.0 μA and approximately 18 μA when the PS was 210 mm/sec.

In this case, the amount of charge on the toner on the intermediate transfer belt 8 after passing the electrically conductive brush 23 was a uniform charge of approximately +5 μC/mg or above, which permits simultaneous transfer and cleaning under any conditions.

As described above, the amount of charge on the toner on the intermediate transfer belt 8 differs between secondary untransferred toner and remaining toner. Therefore, the brush current $I_C$ required for simultaneous transfer and cleaning of the toner also differs, and the charging bias value $V_C$ also differs accordingly, between the charging bias value $V_{C1(210)}$ corresponding to the secondary untransferred toner and the charging bias value $V_{C2(210)}$ corresponding to the remaining toner.

Furthermore, the relationship $V_{C1(210)}<V_{C2(210)}$ is always established between these two charging bias values $V_C$.

This relationship is established similarly in the case where the PS is 105 mm/sec, which is half that of the present embodiment. In other words, a relationship $V_{C1\ (105)}<V_{C2(105)}$ is established between the charging bias value $V_{C1(105)}$ at which the secondary untransferred toner can be charged uniformly, and the charging bias value $V_{C2\ (105)}$ at which the remaining toner can be cleaned. When the PS is 105 mm/sec, a streak image does not occur at the charging bias value $V_{C2\ (105)}$ which permits cleaning of the remaining toner. Therefore, the charging bias value $V_C$ applied to the electrically conductive brush 23 is desirably the charging bias value $V_{C2(105)}$ which enables uniform charging of both the secondary untransferred toner and the remaining toner.

Next, the occurrence of the streak image critical voltage $V_{CL(210)}$ in respect of the charging bias value $V_C$ applied to the electrically conductive brush 23, when the PS is raised from 105 mm/sec to 210 mm/sec, will be described using the surface potential of the intermediate transfer belt 8.

When the charging bias having a charging bias value $V_C$ is applied to the electrically conductive brush 23, then the surface potential $V_{ITB}$ of the intermediate transfer belt 8 is a potential of (charging bias value $V_C$−electric discharge threshold value $V_{CT}$), immediately after passing the electrically conductive brush 23, due to the charging characteristics of the electrically conductive brush 23. In the image forming apparatus 100 according to the present embodiment, the streak image critical voltage $V_{CL(210)}$ was approximately 720 V. Therefore, when the streak image critical voltage $V_{CL(210)}$ is applied, due to the relationship with the electric discharge threshold value $V_{CT}$, the surface potential $V_{ITB@CL\ (210)}$ immediately after passing the electrically conductive brush 23 is approximately 220 V.

Figure 8:
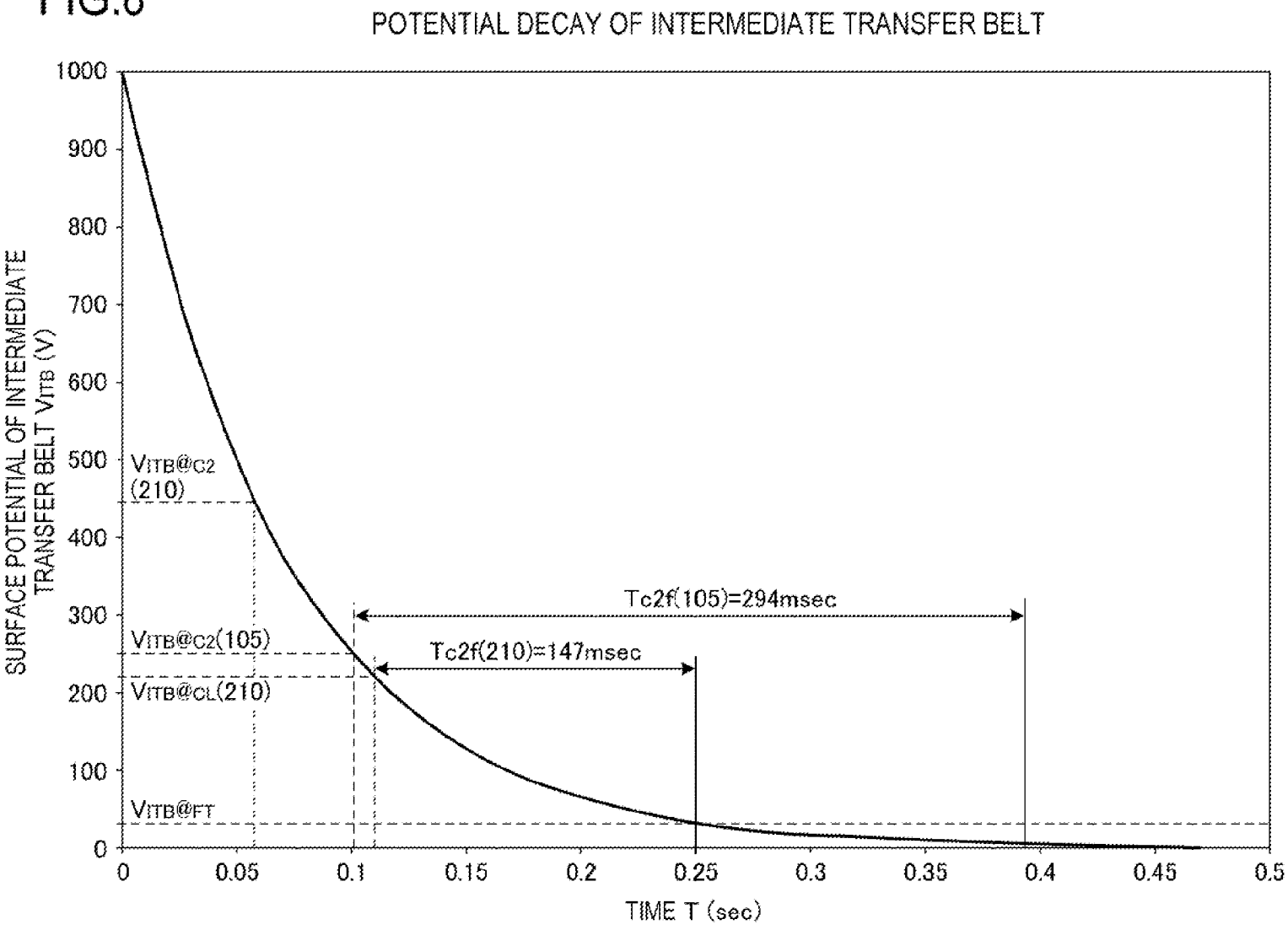
FIG. 8 is a diagram showing the decay characteristics of the surface potential of an intermediate transfer belt according to the first embodiment.

FIG. 8 shows the decay characteristics when the surface potential $V_{ITB}$ of the intermediate transfer belt 8 according to the present embodiment is charged to 1000 V.

When the surface potential $V_{ITB@CL\ (210)}$ of the intermediate transfer belt 8 immediately after application of the streak image critical voltage $V_{CL(210)}$ is approximately 220 V, then the following can be inferred from FIG. 8. More specifically, it can be seen that while the intermediate transfer belt 8 is moving to the first image forming unit PY (after $T_{C2f(210)}$=approximately 146 msec), the surface potential $V_{ITB}$, decays by up to approximately 30 V.

In other words, when there is a relationship of the following kind between the movement time $T_{C2f}$ from the electrically conductive brush 23 to the first image forming unit PY and the surface potential $V_{ITB}$ of the intermediate transfer belt 8, then a streak image does not occur. This is because during the movement time $T_{C2f}$, the surface potential $V_{ITB}$ of the intermediate transfer belt 8 decays to approximately 30 V or lower.

For example, if the PS is 105 mm/sec, then a streak image does not occur at the charging bias value $V_{C2(105)}$ of approximately 740 V at which a brush current $I_{C2(105)}$ which permits simultaneous transfer and cleaning of the remaining toner can be ensured.

In this case, the surface potential $V_{ITB@C2(105)}$ of the intermediate transfer belt 8 immediately after passing the electrically conductive brush 23 was approximately 240 V. The surface potential $V_{ITB@C2(105)}$ was higher than the surface potential $V_{ITB@CL(210)}$ immediately after applying the streak image critical voltage $V_{CL(210)}$ of the intermediate transfer belt 8 at a PS of 210 mm/sec.

However, as FIG. 8 shows, since the PS has become half, the movement time $T_{C2f}$ from the electrically conductive brush 23 to the first image forming unit PY is 292 msec, which is approximately two times longer than when the PS is 210 mm/sec. Therefore, during this time, the surface potential $V_{ITB}$ of the intermediate transfer belt 8 decays sufficiently to a surface potential $V_{ITB@FT}$ at or below 30 V. Consequently, when using a PS of 105 mm/sec, a streak image does not occur, even when using the charging bias value $V_{C2(105)}$ which permits simultaneous transfer and cleaning of the remaining toner, in all of the image forming steps.

On the other hand, if the PS is raised from 105 mm/sec to 210 mm/sec, using the same apparatus configuration, then the surface potential $V_{ITB}$ of the intermediate transfer belt 8 cannot decay to the surface potential $V_{ITB@FT}$ at which a streak image does not occur, in the movement time $T_{C2f}$. Therefore, it is not possible to use the same charging bias value $V_C$ for all of the image forming steps. Consequently, as described above, the state of the remaining toner on the intermediate transfer belt 8 is determined by the remaining toner determination unit, and it becomes necessary to adapt by changing the charging bias value $V_C$ applied to the electrically conductive brush 23, accordingly.

As described previously, in the present embodiment, it is determined whether the toner on the intermediate transfer belt is secondary untransferred toner or remaining toner, and a charging bias value $V_C$ corresponding to the determination result is applied to the electrically conductive brush 23.

Consequently, it is possible to provide an image forming apparatus which operates at a faster speed and has a smaller size, and which ensures cleaning performance at the same time as suppressing streak images, compared to a conventional image forming apparatus using a hybrid method.

Moreover, in the present embodiment, the image formation timing $T_C$ of the next image is delayed until conditions where the charging bias value $V_C$ is greater than the streak image critical voltage $V_{CL}$. Consequently, it is possible to prevent streak images, even in conditions where the charging bias value $V_C$ is greater than the streak image critical voltage $V_{CL}$.

In the present embodiment, the operational status monitoring unit 26*c* is used as a remaining toner determination unit which determines the state of toner on the intermediate transfer belt 8, but the invention is not limited to this. More specifically, as explained above, any unit which is capable of determining the state of the toner on the intermediate transfer belt 8, and in particular, the amount of charge on the toner before arriving at the electrically conductive brush 23, may be used. For example, it is known that the surface potential corresponding to the amount of charge on the toner on the intermediate transfer belt can be measured by measuring the surface potential on the intermediate transfer belt 8 after the secondary transfer step, and that this can also be adapted to change the charging bias value $V_C$. With regard to the change in the charging bias value $V_C$, if the absolute value of the amount of change on the toner remaining on the intermediate transfer belt 8 is less than a threshold value, then the charging bias value $V_C$ is set to the first charging bias value $V_{C1}$, and if the absolute value is equal to or greater than the threshold value, then the charging bias value $V_C$ is set to a second charging bias value $V_{C2}$. Furthermore, in the present embodiment, a case where the normal charging polarity of the toner is a negative polarity has been described, but the invention is not limited to this and the present invention can also be applied suitably to cases where the normal charging polarity of the toner is a positive polarity. In this case, the relationship $|V_{C1}|<|V_{C2}|$ ($|V_1|<|V_2|$) is established between the charging bias values $V_C$, and the relationship $|V_{CT}|\leq|V_{C1}|$, $|V_{CT}|\leq|V_{C2}|$ is established between the charging bias value $V_C$ and the electric discharge threshold value $V_{CT}$.

Furthermore, in the present embodiment, the intermediate transfer belt 8 is used as an intermediate transfer member, but the invention is not limited to this and may also use an intermediate transfer drum having a drum shape. However, from the perspective of the object of the present invention, which is to reduce the size and increase the speed of operation of the apparatus main body, an optimal configuration is one in which the operational status monitoring unit 26*c* of the present embodiment is used as the remaining toner determination unit and the intermediate transfer belt 8 is used as the intermediate transfer member. Furthermore, in the present embodiment, a case where an electrically conductive brush 23 is used as a charging member was described, but the invention is not limited to this, provided that the unremoved toner can be charged in the cleaning step described above. Moreover, in the present embodiment, a case was described in which a belt cleaning blade 21 is employed as a scraping member, but the invention is not limited to this, provided that toner remaining on the intermediate transfer belt 8 can be removed in the cleaning step described above.

[Second Embodiment]

Below, a second embodiment is described. In the present example, constituent portions which are different to the first embodiment are described, and constituent portions which are the same as the first embodiment are omitted from the description.

Figure 9:
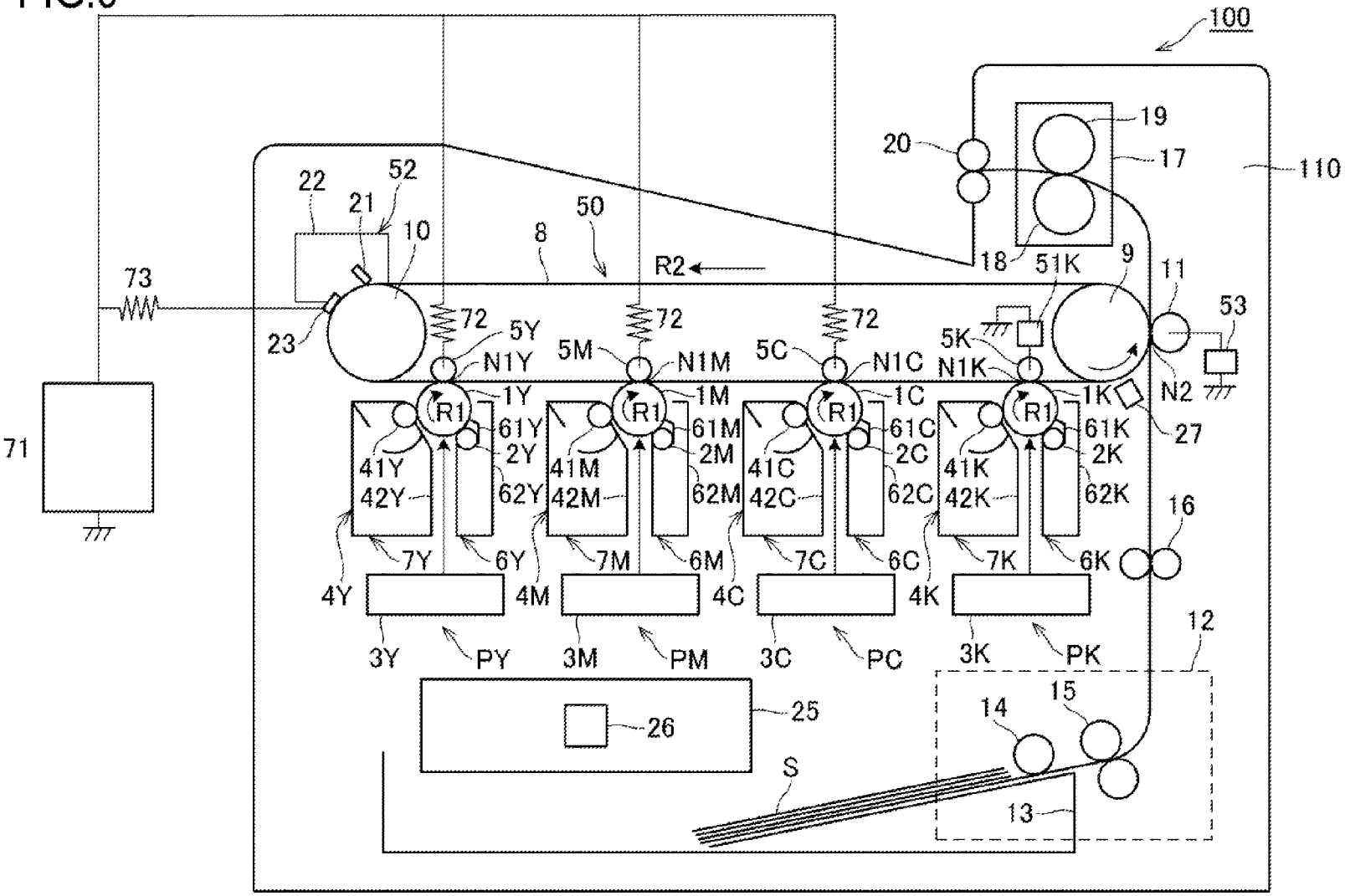
FIG. 9 is a schematic cross-sectional diagram of an image forming apparatus according to a second embodiment.

FIG. 9 is a schematic cross-sectional diagram of an image forming apparatus according to the present embodiment.

As shown in FIG. 9, the characteristic feature of the present embodiment is that the power source for supplying a primary transfer bias to the primary transfer roller 5, and the power source for supplying a charging bias having the charging bias value $V_C$ to the electrically conductive brush 23, are constituted by the same common bias power source 71.

Furthermore, a 100 MΩ high-voltage resistance 72 is provided in the connection path (conduction path) from the output terminal of the common bias power source 71 to the primary transfer roller 5, and a 5 MΩ high-voltage resistance 73 is provided in the connection path from the output terminal of the common bias power source 71 to the electrically conductive brush 23.

The output of the common bias power source 71 is divided by the high-voltage resistances 72, 73, distributed into current values corresponding to the ratio of the resistance values, and then supplied respectively to the primary transfer roller 5 and the electrically conductive brush 23.

When this configuration is used, the primary transfer power sources 51Y, 51M, 51C and the four high-voltage transformers of the charging bias power source 60 in the first embodiment can be integrated into one unit. Thereby, it is possible to reduce elements such as capacitors and diodes, etc. which are the voltage raising circuits associated with high-voltage transformers, and the substrate surface area required to ensure the surface distance between the elements can be reduced.

Consequently, it is possible to greatly reduce the area occupied by the high-voltage circuits in the apparatus, and a merit is obtained in that the apparatus main body can be further reduced in size.

Furthermore, a characteristic feature of the present embodiment is that a coating layer is provided on the front surface of the intermediate transfer belt 8, and the electrically conductive brush 23 is arranged so as to charge the toner on the surface (lower surface) of the intermediate transfer belt 8 that faces downwards in the direction of gravity. Amore detailed description is given below.

Figure 10:
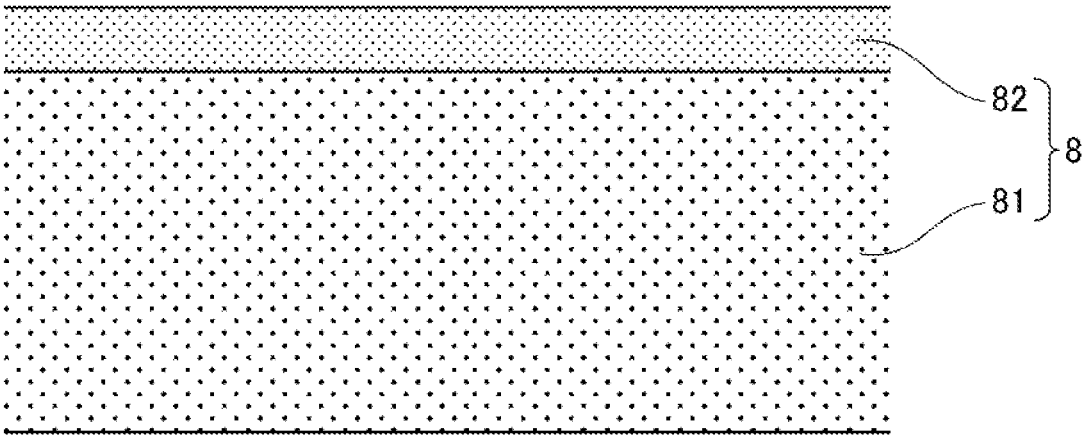
FIG. 10 is a diagram showing the layer configuration of the intermediate transfer belt according to the second embodiment.

FIG. 10 is a diagram showing the layer configuration of the intermediate transfer belt 8 according to the present embodiment.

In the present embodiment, the intermediate transfer belt 8 has a two-layer configuration, comprising a base layer 81 and a coating layer 82. In the present embodiment, the base layer 81 is made of a material of which the main component is polyester, and the thickness thereof is 70 μm. The coating layer 82 is formed by coating the surface of the base layer 81 with acrylic resin material having a thickness of 2 μm. The coating layer (cured resin layer) 82 provides a surface of high smoothness on the intermediate transfer belt 8.

The volume resistivity of the intermediate transfer belt 8 is $1\times10^{10}$ Ω·cm, similarly to the first embodiment, in a state where the coating layer 82 has been formed. The resistance value Ri on the intermediate transfer belt 40 in the portion that contacts the electrically conductive brush 23 is $Ri=6.2\times10^{6}\Omega$, similarly to the first embodiment.

The coating layer 82 has a small film thickness compared to the base layer 81, and therefore has little effect on the resistance value Ri of the intermediate transfer belt 8. However, an electrically conductive agent, such as carbon black, may be added to adjust the electrical resistance, according to requirements. Furthermore, the thickness of the coating layer 82 is desirably in a range of 0.5 to 4.0 μm, from the perspective of smoothness and manufacturing properties.

The material of the base layer 81 is not limited to that of the present embodiment. For example, it is possible to use other materials such as the following, provided that the material is a thermoplastic resin. Possible examples of the material are: polyimide, polycarbonate, polyarylate, acrylonitrile butadiene-styrene copolymer (ABS), polyphenylene sulphide (PPS), polyvinylidene fluoride (PVdF), or the like, and combined resins of these. Moreover, the material of the resin coated onto the base layer 81 as the coating layer 82 is not limited to that of the present embodiment; for example, it is possible to use a material such as polyester, polyether, polycarbonate, polarylate, urethane, silicone, fluorine resin, or the like. Furthermore, the base layer 81 may have a single layer or multiple layers, provided that a coating layer 82 is provided on the base layer and this coating layer 82 constitutes the surface layer of the intermediate transfer belt 8 which bears the toner.

In the present embodiment, by providing a coating layer 82 on the surface layer of the intermediate transfer belt 8, it is possible to level out any unevenness of the base layer 81 which may occur during manufacture. Therefore, it is possible to raise the smoothness of the surface of the intermediate transfer belt 8. The smoothness of the surface of the coating layer 82 should be higher than the smoothness of the surface of the base layer 81, when the coating layer 82 is not provided (in other words, should have lower unevenness). More specifically, desirably, the smoothness is in a range of 0.1 to 0.7 in terms of an Rz value according to JIS (2001), and more desirably, a range of 0.3 to 0.5.

When the smoothness of the surface of the intermediate transfer belt 8 is improved, it is possible to raise the adhesiveness between the belt cleaning blade 21 and the uneven portions of the surface of the intermediate transfer belt 8. Consequently, the amount of unremoved toner is reduced.

As described in the first embodiment, the charging bias applied to the electrically conductive brush 23 is determined in accordance with the amount of charge on the unremoved toner, and therefore if the amount of unremoved toner is smaller, then the charging bias value $V_C$ which permits simultaneous transfer and cleaning of this toner can be kept to a low value. Consequently, the image forming method according to the first embodiment has a merit in that further size reduction and speed increase can be achieved in the apparatus.

Figure 11:
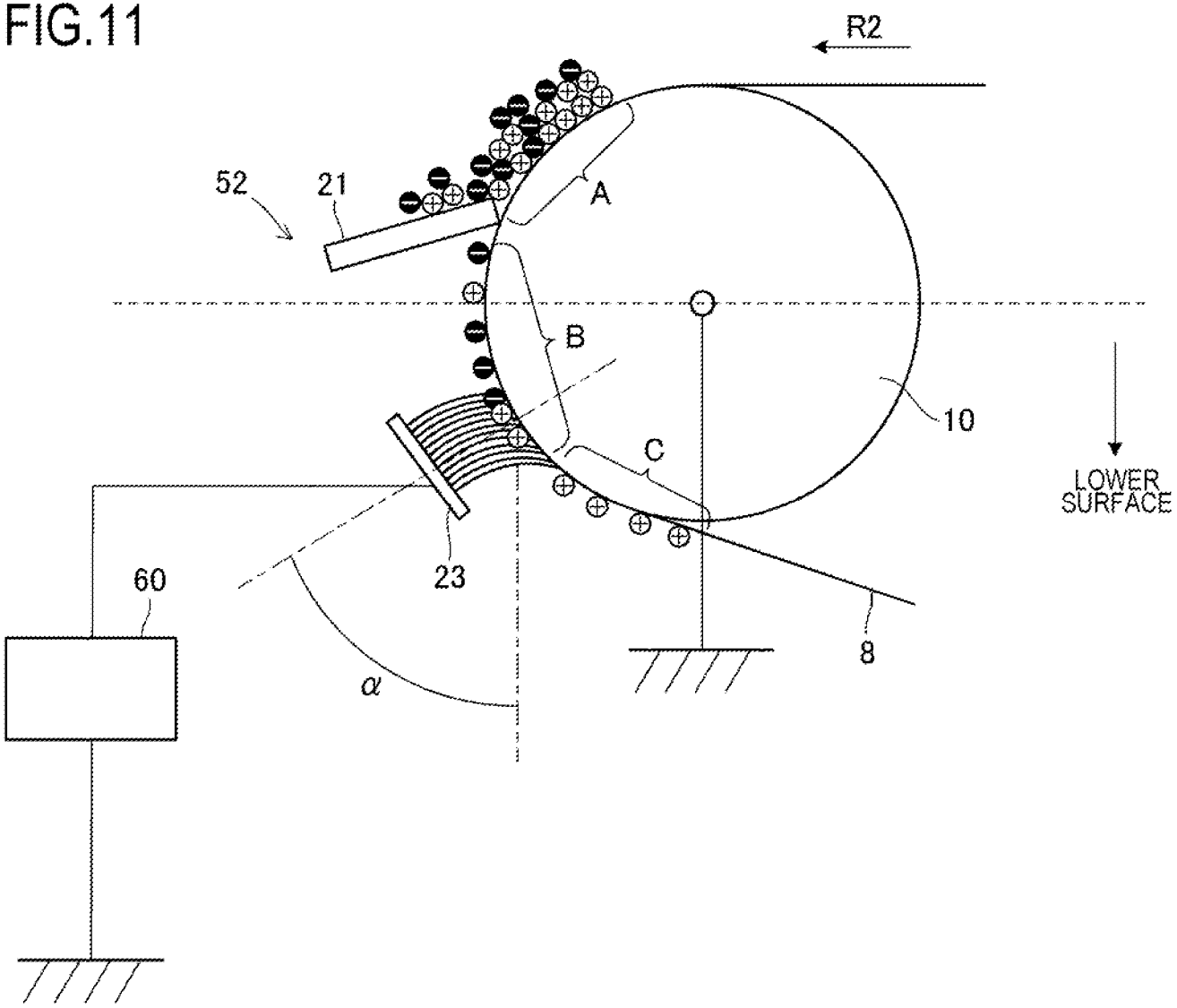
FIG. 11 is a schematic drawing showing the vicinity of a belt cleaner according to a second embodiment.

Next, the configuration of the electrically conductive brush 23 according to the present embodiment will be described. FIG. 11 is a schematic drawing showing a more detailed view of the vicinity of the belt cleaner 52 in the present embodiment.

The electrically conductive brush 23 according to the present embodiment is arranged so as to charge the toner on the surface of the intermediate transfer belt 8 which faces downwards in the direction of gravity (the region of the front surface of the intermediate transfer belt 8 which faces downwards in the direction of gravity). In the present embodiment, the electrically conductive brush 23 which has substantially the same configuration as that of the first embodiment is arranged so as to contact the surface (lower surface) of the intermediate transfer belt 8 which faces downwards in the direction of gravity.

Here, the lower surface of the intermediate transfer belt 8 means the front surface of the intermediate transfer belt 8 (the surface carrying the toner image) at a position facing downwards in the direction of gravity, when the image forming apparatus 100 is in a usable state. More specifically, the lower surface of the intermediate transfer belt 8 faces at least downwards from a horizontal direction, when the image forming apparatus 100 is in a usable state. As shown in FIG. 11, in the present embodiment, the lower surface of the intermediate transfer belt 8 is the front surface of the intermediate transfer belt 8 at a position to the lower side, in the direction of gravity, of a plane (the dotted line in FIG. 11) which is horizontal (perpendicular to the vertical direction) and passes through the center of rotation of the tension roller 10.

In order to achieve the effects described below more prominently, the angle formed between the normal direction of the surface (lower surface) of the intermediate transfer belt 8 at the position where charging of the toner is carried out, and the direction of gravity (the angle α in FIG. 11), is desirably 0 degrees (an angle facing directly in the direction of gravity) to 45 degrees.

In this way, by arranging the electrically conductive brush 23 so as to charge the toner on the lower surface of the intermediate transfer belt 8, it is possible to improve the effect of physical scattering of the unremoved toner by the electrically conductive brush 23, and the unremoved toner can be charged more uniformly. Upon passing the belt cleaning blade 21, the unremoved toner may be pressed and compacted against the intermediate transfer belt 8 by the belt cleaning blade 21, thus becoming more difficult to scatter.

Therefore, it is effective to arrange the electrically conductive brush 23 as indicated in the present embodiment.

In other words, when the electrically conductive brush 23 is arranged so as to charge the toner on the lower surface of the intermediate transfer belt 8, the direction of gravity received by the unremoved toner coincides with the direction in which the toner falls off the intermediate transfer belt 8. Therefore, when the tip of the electrically conductive brush 23 contacts the unremoved toner, the unremoved toner can be scattered more readily. As a result of this, even in cases where the unremoved toner has a height of multiple layers, and it is essentially difficult to charge the toner on the lower surface, due to the scattering effect of the electrically conductive brush 23, the unremoved toner can be charged while being adjusted to substantially the height of one layer. Therefore, a positive charge suitable for achieving electrostatic cleaning can be applied. Consequently, in the present embodiment, the unremoved toner of negative polarity which becomes attached to the tip of the electrically conductive brush 23 can also be charged readily to a positive polarity.

In this way, in the present embodiment, the power source for supplying a primary transfer bias to the primary transfer roller 5, and the power source for supplying a charging bias having the charging bias value $V_C$ to the electrically conductive brush 23, are constituted by the same common bias power source 71. Furthermore, the electrically conductive brush 23 according to the present embodiment is configured to charge the toner on the surface of the intermediate transfer belt 8 which is facing downwards in the direction of gravity. In addition, the intermediate transfer belt 8 of the present embodiment uses a multiple-layer belt having a base layer 81 configured by a single layer or multiple layers, and a coating layer 82 which constitutes a surface layer of the intermediate transfer belt 8 and is provided on top of the base layer 81.

As described above, according to the present embodiment, since the electrically conductive brush 23 is arranged so as to charge the toner on the lower surface of the intermediate transfer belt 8, it is possible to scatter the unremoved toner more readily, and the unremoved toner can be charged more uniformly.

Moreover, according to the present embodiment, similar effects to those of the first embodiment are achieved, and furthermore, by providing the coating layer 82 on the surface of the intermediate transfer belt 8, the amount of unremoved toner can be reduced. Consequently, according to the present embodiment, it is possible to maintain a low brush current $I_{C2}$ corresponding to the amount of unremoved toner, and, at the same time, to maintain a charging bias value $V_{C2}$ at a low level. Therefore, according to the configuration of the present embodiment, further size reduction and speed increase can be achieved in the apparatus than when using the image forming method according to the first embodiment.

(Third Embodiment)

Below, a third embodiment is described. In the present embodiment, constituent portions which are different to the first and second embodiments are described, and constituent portions which are the same as the first embodiment are omitted from the description.

In the first and second embodiments described above, a configuration which prevents streak images and enables faster operation and smaller size of the image forming apparatus was described. In other words, in the embodiments described above, a remaining toner determination unit which evaluates the toner on the intermediate transfer belt 8 at least determines whether the toner is secondary untransferred toner or remaining toner, and a charging bias value $V_C$ corresponding to this is applied. Moreover, the image formation timing $T_C$ of the next image is delayed until conditions where the charging bias value $V_C$ is greater than the streak image critical voltage $V_{CL}$.

However, the embodiments described above state as a condition that the charging bias value $V_{C1}$ permitting simultaneous transfer and cleaning of the secondary untransferred toner be lower than streak image critical voltage $V_{CL}$. Therefore, when the process speed is raised further to 210 mm/sec, situations may occur where the abovementioned condition cannot be satisfied.

There follows a description of a case where the abovementioned condition is not satisfied and a hybrid cleaning method for such cases.

Firstly, a case where the abovementioned condition is not satisfied when the process speed is raised will be described.

When the process speed is raised beyond 210 mm/sec, the movement time $T_{C2f}$ from the electrically conductive brush 23 to the first image forming unit PY falls, and due to the relationship indicated in FIG. 8, the streak image critical voltage $V_{CL}$ becomes lower, and therefore the charging bias value $V_{C1}$ must be set to a lower value. However, the charging bias value $V_{C1}$ in this case gradually approaches the electric discharge threshold value $V_{CT}$, as the process speed is increased, and therefore the differential between the charging bias value $V_{C1}$ and the electric discharge threshold value $V_{CT}$ becomes narrower. Therefore, if voltage ripples, or the like, occur in the charging bias power source 60, then the charging bias value $V_{C1}$ applied to the electrically conductive brush 23 may become lower than the electric discharge threshold value $V_{CT}$, and stable electric discharge may not be performed.

Therefore, the charging bias value $V_{C1}$ is limited to a value of approximately 600 V, which is approximately 100 V higher than the electric discharge threshold value $V_{CT}$. Consequently, as described in the first embodiment, approximately 100 V is the lower limit of the surface potential $V_{ITB}$ on the intermediate transfer belt 8 after passing the electrically conductive brush 23. If the process speed is increased further, then there is also a limit on the process speed at which the surface potential $V_{ITB}$ at this value of approximately 100 V can decay to approximately 30 V during the movement time $T_{C2f}$ from the electrically conductive brush 23 to the first image forming unit PY. Here, this value of approximately 30 V is the surface potential $V_{ITB@FT}$ of the intermediate transfer belt 8 at which streaks do not occur, as described above.

From the potential decay characteristics of the intermediate transfer belt 8 illustrated in FIG. 8, in order for the surface potential $V_{ITB}$ of approximately 100 V on the intermediate transfer belt 8 to decay to approximately 30 V, it is necessary to ensure a movement time $T_{C2f}$ from the electrically conductive brush 23 to the first image forming unit PY of no less than 75 msec. In order to satisfy this condition in the image forming apparatus used in the first embodiment, the process speed has a limit of up to 408 mm/sec.

In other words, if the process speed exceeds 408 mm/sec, then in the image forming method described in the first embodiment, there is a risk that continuous image formation will not be possible while preventing streak images.

Below, a cleaning method according to the present embodiment in a case where the abovementioned condition is not satisfied will be described.

In the present embodiment, similarly to the first embodiment a remaining toner determination unit which evaluates the toner on the intermediate transfer belt 8 at least determines whether the toner is secondary untransferred toner or remaining toner, and a charging bias having a charging bias value of $V_C$ corresponding to this is applied.

However, the present embodiment differs from the embodiment described above in that a charging bias value $V_{C1}$ ($|V_{CT}|>|V_{C1}|$) which is less than the electric discharge threshold value $V_{CT}$ of the electrically conductive brush 23 is applied as the charging bias value $V_C$ to be applied when the toner on the intermediate transfer belt 8 is determined to be secondary untransferred toner.

Electric discharge does not occur at the electrically conductive brush 23 when the charging bias value $V_C$ of the charging bias applied to the electrically conductive brush 23 is lower than the electric discharge threshold value $V_{CT}$. Therefore, the unremoved toner which is secondary untransferred toner arriving at the electrically conductive brush 23 can be captured (collected, recovered) (by electrically adhering to) the electrically conductive brush 23 which is of opposite polarity to the toner.

When a charging bias having a charging bias value $V_C$ which is equal to or greater than the electric discharge threshold value $V_{CT}$ is applied to the electrically conductive brush 23, then electric discharge will have started already between the electrically conductive brush 23 and the intermediate transfer belt 8, before the toner comes into contact with the electrically conductive brush 23. Therefore, when the toner makes contact with the electrically conductive brush 23, the toner is charged to a positive polarity. Consequently, the unremoved toner which is secondary untransferred toner does not adhere to the electrically conductive brush 23 to which a charging bias value $V_C$ of positive polarity has been applied.

However, if the charging bias value $V_C$ is lower than the electric discharge threshold value $V_{CT}$ as described above, then the polarity of the toner when the toner comes into contact with the electrically conductive brush 23 remains negative. Consequently, the unremoved toner which is secondary untransferred toner adheres to and is captured by the electrically conductive brush 23 to which a charging bias value $V_C$ of positive polarity has been applied.

The amount of the secondary untransferred toner conveyed to the cleaning blade of the belt cleaner 52 is much smaller compared to the amount of toner occurring in a jam processing step or calibration step, and therefore, the amount of unremoved toner that is not removed by the cleaning blade is extremely small.

Consequently, in each of a plurality of image-formation processes, as described above, the charging bias value $V_C$ that is applied to the electrically conductive brush 23 as described above is set to a voltage lower than the electric discharge threshold value $V_{CT}$, and therefore good image formation can be carried out continuously, even when unremoved toner is captured by the electrically conductive brush 23.

As indicated below, the unremoved toner captured by the electrically conductive brush 23 can be ejected (moved) from the electrically conductive brush 23 to the intermediate transfer belt 8. More specifically, the toner can be ejected onto the intermediate transfer belt 8 either by cutting the charging bias applied to the electrically conductive brush 23 (halting the application of voltage), or by applying an ejection bias value $V_H$ of negative polarity, which is the same as the normal charging polarity of the toner, to the electrically conductive brush 23.

The toner which has been ejected onto the intermediate transfer belt 8 (called "ejected toner" below) has a negative polarity, even after being ejected, and is hardly collected at all in the primary transfer portion, but rather is collected by the belt cleaning blade 21 of the belt cleaner 52 which is positioned further to the downstream side in terms of the direction of rotation of the intermediate transfer belt. Of course, toner which is not scraped off by the belt cleaning blade 21 also occurs in this collecting action, but the amount thereof is greatly reduced compared to the amount of ejected toner, and this unremoved toner is collected again on the electrically conductive brush 23 to which a voltage of the charging bias value $V_C$ has been applied.

By performing an ejection step to eject toner from the electrically conductive brush 23 onto the intermediate transfer belt 8 each time a prescribed number of prints has been made, or during post-printing rotation, the capacity of the electrically conductive brush 23 to capture unremoved toner can be kept uniform.

When the ejected toner which has been ejected onto the intermediate transfer belt 8 in the ejection step arrives at the secondary transfer portion due to the rotation of the intermediate transfer belt 8, then a secondary transfer reverse bias of a negative polarity is applied to the secondary transfer roller. By this means, the ejected toner is prevented from adhering to the secondary transfer roller.

Figure 12:
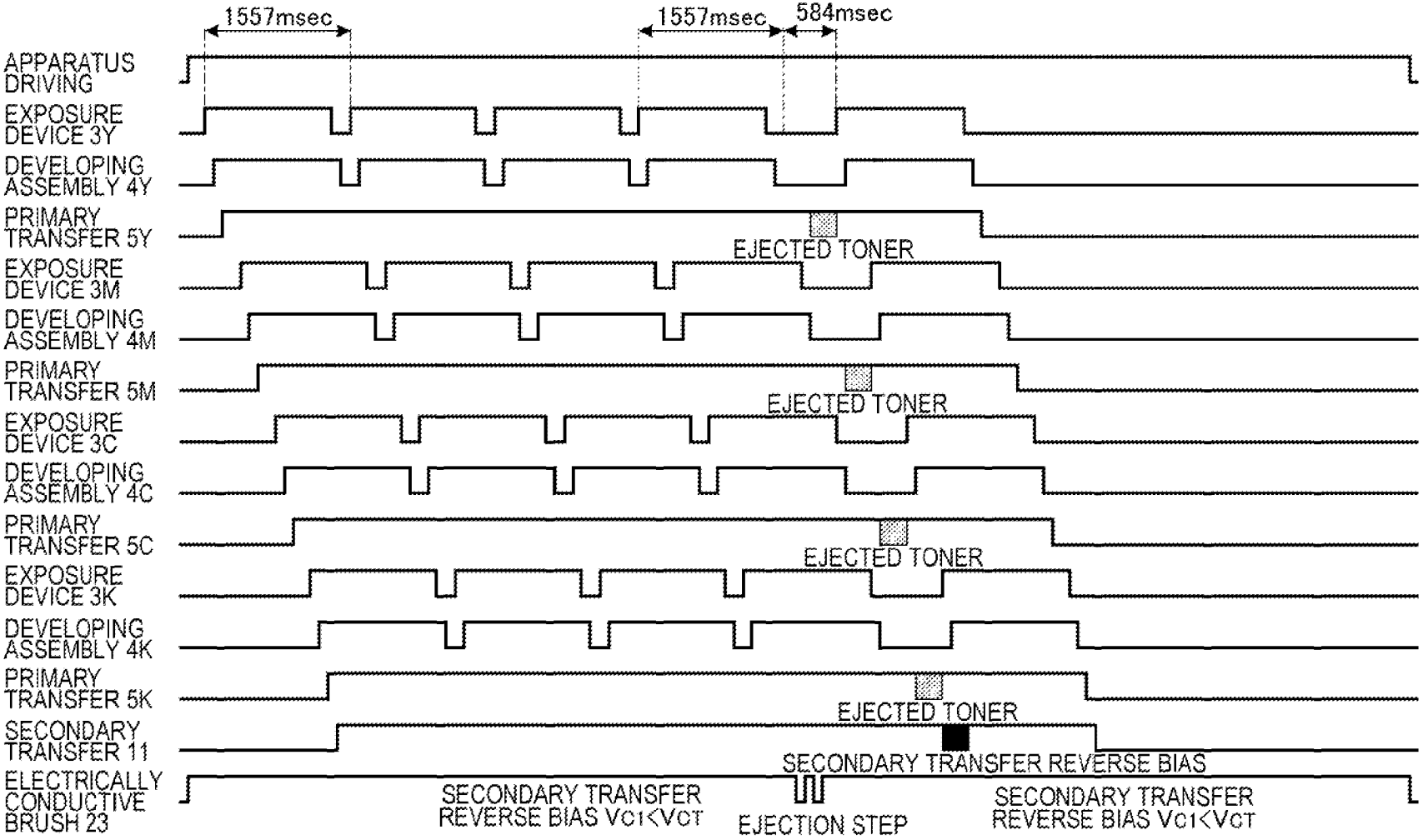
FIG. 12 is a diagram showing a timing chart of image formation according to a third embodiment.

FIG. 12 shows a timing chart of image formation including the ejection step according to the present embodiment.

In the present timing chart, when toner is ejected from the electrically conductive brush 23, the charging bias value $V_{C1}$ applied to the electrically conductive brush 23 is switched on and off with a short cycle.

As described previously, in the image forming apparatus according to the present embodiment, firstly, a remaining toner determination unit which evaluates toner on the intermediate transfer belt 8 determines at least whether the toner is secondary untransferred toner or remaining toner. If the toner on the intermediate transfer belt 8 is determined to be secondary untransferred toner, then in the present embodiment, the toner is captured by using a charging bias value $V_{C1}$ that is less than the electric discharge threshold value $V_{CT}$. When the toner on the intermediate transfer belt 8 is remaining toner, then a charging bias value $V_{C2}$ equal to or greater than the electric discharge threshold value $V_{CT}$ is used, and the image formation timing $T_C$ of the next image is delayed. In this way, a cleaning operation for preventing streak images is carried out. By using the image forming method according to the present embodiment, it is possible to carry good image formation, even under conditions according which the charging bias value $V_{C1}$, which permits simultaneous transfer and cleaning of the secondary untransferred toner, cannot be lower than the streak image critical voltage $V_{CL}$. Consequently, further size reduction and speed increase can be achieved in the apparatus.

The present embodiment has been described with reference to the process speed in conditions where the charging bias value $V_{C1}$ that permits simultaneous transfer and cleaning of the secondary untransferred toner is at the limit of the charging bias power source and cannot reliably be made lower than the streak image critical voltage $V_{CL}$. However, if the resistance value Ri of the intermediate transfer belt 8 varies with the environment in which the apparatus is operated, for instance, then there are also process speeds at which the condition may be satisfied in some cases and not satisfied in other cases.

Under conditions such as these, it is possible to respond by switching between the image forming method according to the first embodiment and the image forming method according to the present embodiment, by using a temperature and humidity sensor as a prediction unit for predicting variation in the resistance of the intermediate transfer belt 8, for example, an environment sensor. Here, the environment sensor corresponds to a detection unit for detecting the temperature and humidity of the environment in which the image forming apparatus is installed.

In other words, it is possible to carry out optimal image formation under the conditions described above, by implementing the following control. Firstly, the variation in the resistance value Ri of the intermediate transfer belt 8 is predicted in accordance with the value of the temperature and humidity sensor. A charging bias selection unit is able to select whether to set the charging bias value $V_{C1}$ to a charging bias value $V_{C1}$ equal to or greater than the electric discharge threshold value $V_{CT}$ or a charging bias value $V_{C1}$ lower than the electric discharge threshold value $V_{CT}$, in accordance with the prediction. An image forming method corresponding to the selected charging bias value $V_{C1}$ is selected.

To give a more detailed description, when a high-temperature high-humidity environment is detected by the humidity sensor, it is predicted that the resistance of the intermediate transfer belt 8 will vary so as to become lower, and therefore the potential decay rate of the intermediate transfer belt 8 will become faster and hence the streak image critical voltage $V_{CL}$ will become higher. Therefore, it is possible to set a value higher than the charging bias value (third set value $V_3$) that is set when a high-temperature high-humidity environment is detected, and even taking account of ripples in the high-voltage power source, the charging bias can be set to a value equal to or greater than the electric discharge threshold value $V_{CT}(|V_{CT}|\leq|V_3|)$, and therefore the control described in the first embodiment is possible. Consequently, when a high-temperature high-humidity environment is detected by the humidity sensor, there is no need to capture the toner by the electrically conductive brush 23, as in the case of applying the charging bias value $V_{C1}$ lower than the electric discharge threshold value as described above, and there is no need to perform an operation for ejecting the collected toner.

On the other hand, when a low-temperature low-humidity environment is detected by the humidity sensor, it is predicted that the resistance of the intermediate transfer belt 8 will vary so as to become higher, and therefore the potential decay rate of the intermediate transfer belt 8 will become slower and hence the streak image critical voltage $V_{CL}$ will become lower. Therefore, the charging bias value $V_{C1}$ becomes smaller and is set to a value lower than the electric discharge threshold value $V_{CT}$, and as described above, the toner is captured by the electrically conductive brush 23.

As described above, according to the present embodiment, due to further increase in the process speed, it is possible to provide good cleaning performance even under conditions where the charging bias value $V_{C1}$ cannot be made lower than the streak image critical voltage $V_{CL}$, and therefore further size reduction and increase in speed can be achieved in the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-174413, filed Aug. 28, 2014, which is hereby incorporated by reference herein in its entirety.

What is claimed is:

1. An image forming apparatus, comprising:

an image bearing member which bears a toner image;

an intermediate transfer member which is movable and to which a toner image is primarily transferred from the image bearing member in a primary transfer portion;

a secondary transfer member to which a voltage of opposite polarity to a normal polarity of the toner is applied, and which secondarily transfers the toner image from the intermediate transfer member to a transfer material, in a secondary transfer portion;

a control unit; and a cleaning unit which cleans toner on the intermediate transfer member, the cleaning unit including:

a cleaning member which contacts the intermediate transfer member and collects toner, and a charging member which is disposed on a downstream side of the cleaning member in terms of a direction of movement of the intermediate transfer member, and which charges the toner by receiving application of a voltage of the opposite polarity, wherein the control unit:

applies a first voltage to the charging member while causing the intermediate transfer member to move at a first speed of movement, when cleaning toner remaining on the intermediate transfer member due to not having been secondarily transferred to the transfer material, by the cleaning unit, and applies a second voltage having a greater absolute value than the first voltage, to the charging member, while causing the intermediate transfer member to move at a second speed of movement that is slower than the first speed of movement, when cleaning toner that has been primarily transferred to the intermediate transfer member, in a state where a voltage of the normal polarity has been applied to the secondary transfer member, or a state where the secondary transfer member has been separated from the intermediate transfer member, by the cleaning unit.

2. The image forming apparatus according to claim 1, wherein the first voltage is a voltage lower than an electric discharge threshold value, and the second voltage is a voltage equal to or greater than the electric discharge threshold value.

3. The image forming apparatus according to claim 1, wherein the remaining toner charged to the opposite polarity by the charging member is moved from the intermediate transfer member to the image bearing member in the primary transfer portion, simultaneously with the primarily transferring of the toner image from the image bearing member to the intermediate transfer member.

4. The image forming apparatus according to claim 1, further comprising a plurality of image bearing members disposed on the downstream side of a first image bearing member, which is the image bearing member, in the direction of movement of the intermediate transfer member.

5. The image forming apparatus according to claim 4, further comprising a plurality of stretching members which stretch the intermediate transfer member, wherein the cleaning unit opposes the stretching member situated closest to the first image bearing member, via the intermediate transfer member.

6. The image forming apparatus according to claim 5, wherein the cleaning member is a rubber blade and the charging member is a charging brush which is fixed with respect to the intermediate transfer member while said intermediate transfer member moves.

7. The image forming apparatus according to claim 1, wherein the control unit implements control to start a printing operation at a timing later than a predetermined timing, when applying the second voltage.

8. The image forming apparatus according to claim 1, wherein the charging member charges the toner borne on the region of the surface of the intermediate transfer member, which faces downwards in a direction of gravity.

9. The image forming apparatus according to claim 1, further comprising:

a primary transfer member for transferring a toner image from the image bearing member to the intermediate transfer member, and a common power source which applies a voltage to the primary transfer member and the charging member.

* * * * *